US010907884B1

(12) United States Patent
Scorsim et al.

(10) Patent No.: US 10,907,884 B1
(45) Date of Patent: Feb. 2, 2021

(54) DOOR END CLOSURE ASSEMBLY WITH INTEGRATED USER INTERFACE

(71) Applicant: Electrolux Home Products, Inc., Charlotte, NC (US)

(72) Inventors: Fellipe Vinicius Marinho Scorsim, Curitiba (BR); Carlos Cordero, Anderson, SC (US); Raony Barrios, Anderson, SC (US); John Thomas Campbell, III, Anderson, SC (US); Cristhian Camilo Serrano Camacho, Anderson, SC (US); Ran Zhou, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/658,619

(22) Filed: Oct. 21, 2019

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01); *F25D 2400/361* (2013.01)

(58) Field of Classification Search
CPC .. F25D 23/028; F25D 2323/02; F25D 29/005; F25D 2400/361; A47B 88/919; A47B 88/90
See application file for complete search history.

(56) References Cited

U.S. PATENT DOCUMENTS 6,098,411 A 8/2000 Jeon
D668,403 S 10/2012 Eng et al.
D684,736 S 6/2013 Eng et al.
D702,898 S 4/2014 Eng et al.
8,960,934 B2 2/2015 Sung et al.
D732,755 S 6/2015 Roberson et al.
D743,121 S 11/2015 Roberson et al.
(Continued)

FOREIGN PATENT DOCUMENTS

DE 102012200810 7/2013
DE 102019202154 9/2019
(Continued)

OTHER PUBLICATIONS

International Search Report for PCT/US2020/050377 dated Nov. 23, 2020. 3 pages.

*Primary Examiner* — Daniel J Rohrhoff
(74) *Attorney, Agent, or Firm* — Pearne & Gordon LLP

(57) ABSTRACT

A refrigeration appliance includes a compartment for storing food items in a refrigerated environment, and a door for engaging with an appliance body and selectively closing the compartment. The door has a front panel, a rear panel, and a door end closure assembly providing an end of the door. The closure assembly includes an endcap extending between the front panel and the rear panel and a user interface engaged with the endcap. The user interface is configured to allow control of or to provide feedback regarding one or more aspects of the appliance to the user. The endcap defines at least a portion of a handle gap configured to receive at least a portion of a user's hand to allow for selective opening of the compartment, and an interface cavity for receiving the user interface. The interface cavity is separated from the handle gap and closed by the user interface.

20 Claims, 22 Drawing Sheets

(56) References Cited

U.S. PATENT DOCUMENTS

| | | | | |
|---|---|---|---|---|
| D748,353 | S | 1/2016 | Roberson et al. | |
| D756,046 | S | 5/2016 | Roberson et al. | |
| D765,923 | S | 9/2016 | Roberson et al. | |
| D778,008 | S | 1/2017 | Roberson et al. | |
| 9,664,435 | B2 | 5/2017 | Sung et al. | |
| 9,791,204 | B2 | 10/2017 | Kim et al. | |
| 9,939,190 | B2 | 4/2018 | Sung et al. | |
| 10,036,181 | B2 | 7/2018 | Viswanathan et al. | |
| 10,082,327 | B2 | 9/2018 | Kim et al. | |
| 2006/0202596 | A1 | 9/2006 | Bauer et al. | |
| 2006/0250062 | A1* | 11/2006 | Janda | A47B 88/994 312/402 |
| 2007/0194675 | A1 | 8/2007 | Van Beek | |
| 2011/0006655 | A1* | 1/2011 | Seo | F25D 25/025 312/402 |
| 2011/0209493 | A1* | 9/2011 | Schenk | F25D 29/008 62/389 |
| 2018/0164031 | A1 | 6/2018 | Lee | |
| 2018/0187951 | A1* | 7/2018 | Seo | F25D 29/008 |
| 2018/0320953 | A1* | 11/2018 | Heisswolf | F25D 23/02 |
| 2019/0120547 | A1* | 4/2019 | Staud | F25D 23/028 |
| 2020/0072544 | A1* | 3/2020 | Lee | F25D 11/02 |

FOREIGN PATENT DOCUMENTS

| | | | | |
|---|---|---|---|---|
| EP | 2182145 | | 5/2010 | |
| WO | 2018177831 | | 10/2018 | |
| WO | 2019170520 | | 9/2019 | |
| WO | 2019170522 | | 9/2019 | |
| WO | WO-2019170520 | A1 * | 9/2019 | F25D 29/005 |
| WO | 2004065867 | | 10/2019 | |

* cited by examiner

DOOR END CLOSURE ASSEMBLY WITH INTEGRATED USER INTERFACE

FIELD OF THE INVENTION

This application relates generally to a door end closure assembly for a door of a refrigeration device, and more particularly to said closure assembly having a handle for aiding a user in opening the door and an integrated user interface for providing information to a user and/or for allowing control of one or more aspects of the refrigeration appliance.

BACKGROUND OF THE INVENTION

Conventional refrigeration appliances, such as domestic refrigerators, have one or more compartments, and typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access and thus separate doors are provided for the compartments so that either compartment may be accessed without exposing the other compartment to the ambient air.

Conventional closure for these compartments can include hinged doors, drawer doors, or any combination thereof. Typically a hinged door is hinged either on a left side or a right side of the door. A drawer door typically is provided on a sliding and/or tilting drawer. Both door types, conveniently referred to herein generally as doors or compartment closures, are configured to engage with a front surface of a body of the refrigeration appliance, generally around an outer periphery of a respective compartment, such as to seal that compartment from the ambient air.

The doors typically are the most visible aspects of a refrigeration appliance, and can provide both aesthetic and utility functions to the owner. As owners of the appliances desire greater control, customization and functionality from their devices, these desires often do not align with a state of conventional controls available in such refrigeration appliances, nor with the location of the conventional controls, which generally are located internally, in the food compartments, if provided at all. Instead, users now are desiring to have these features provided in visible and easy to access locations, one of which being the doors. Where external controls are contemplated, their incorporation, particularly related to manufacturing, should not be over-complicated.

BRIEF SUMMARY OF THE INVENTION

Aspects of the present disclosure may address one or more of the concerns described above while providing at least one compartment closure that includes additional utility for a user beyond that of merely sealing a food compartment of a refrigeration appliance.

In accordance with one aspect, a refrigeration appliance includes a body defining a compartment for storing food items in a refrigerated environment, and a door for engaging with the body and selectively closing the compartment. The door has a front panel and a rear panel, with the front panel disposed outwardly from the compartment and the rear panel facing the compartment when the door is engaged with the body. A door end closure assembly provides an end of the door adjacent to each of the front panel and the rear panel. The door end closure assembly includes an endcap extending between the front panel and the rear panel and a user interface engaged with the endcap. The user interface is configured to allow control of or to provide feedback regarding one or more aspects of the appliance to the user. The endcap defines at least a portion of a handle gap configured to receive at least a portion of a user's hand to allow for selective opening of the compartment, and an interface cavity for receiving the user interface. The interface cavity is separated from the handle gap and closed by the user interface, which extends along the handle gap and is provided at an outer main surface of the endcap.

In accordance with another aspect, there is provided a door end closure assembly for closing an end of an appliance door. The door end closure assembly includes an endcap configured to engage with front and rear panels of the appliance door to close an end of the door, and the endcap having a handle extending along a length of the endcap. The door end closure assembly also includes an intermediate member for mounting a front of the endcap to at least the front panel, and a user interface retained in an interface cavity extending along the length of the endcap, generally parallel to the handle. The user interface is configured to allow control of one or more aspects of the appliance. The endcap includes an outwardly opening groove extending peripherally about an opening of the interface cavity. The user interface includes a board housing received into the interface cavity and retaining an electronics board of the user interface therein. The board housing has a downwardly extending lip disposed about a periphery of the board housing and configured to be received into the outwardly opening groove of the endcap to provide therewith a labyrinth closure to restrict moisture infiltration into the interface cavity.

In accordance with still another aspect, there is provided a door end closure assembly for closing an end of a refrigeration appliance door. The door end closure assembly includes an endcap having an interface cavity extending along a length of the endcap. The the interface cavity receives a user interface to provide control of or feedback regarding one or more aspects of the refrigeration appliance. The user interface is retained in the interface cavity and forms with the endcap an S-shaped closure disposed fully-circumferentially about the interface cavity to restrict water infiltration into the interface cavity. The user interface includes an electronics board retained both within a board housing of the user interface and within the interface cavity that receives the board housing extended thereinto. The electronics board is electrically coupled to an outer surface of the board housing for being contacted by a user to thereby send signals to the electronics board.

The foregoing and other features of the invention are hereinafter described in greater detail with reference to the accompany drawings.

BRIEF DESCRIPTION OF THE DRAWINGS

The accompanying drawings, which are not necessarily to scale, show various aspects of the disclosure.

DESCRIPTION OF EXAMPLE EMBODIMENTS

Figure 1:
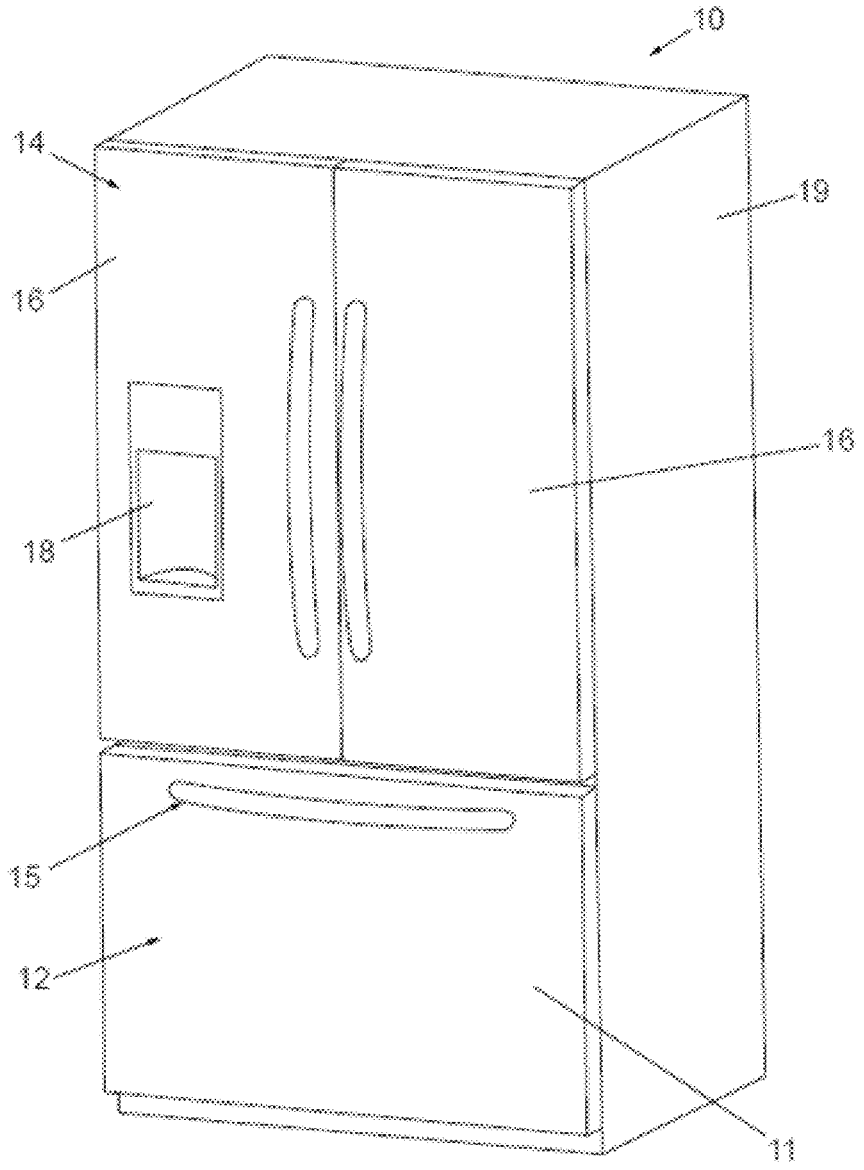
FIG. 1 is a front perspective view of a household French door bottom mount refrigerator showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can span the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

Figure 2:
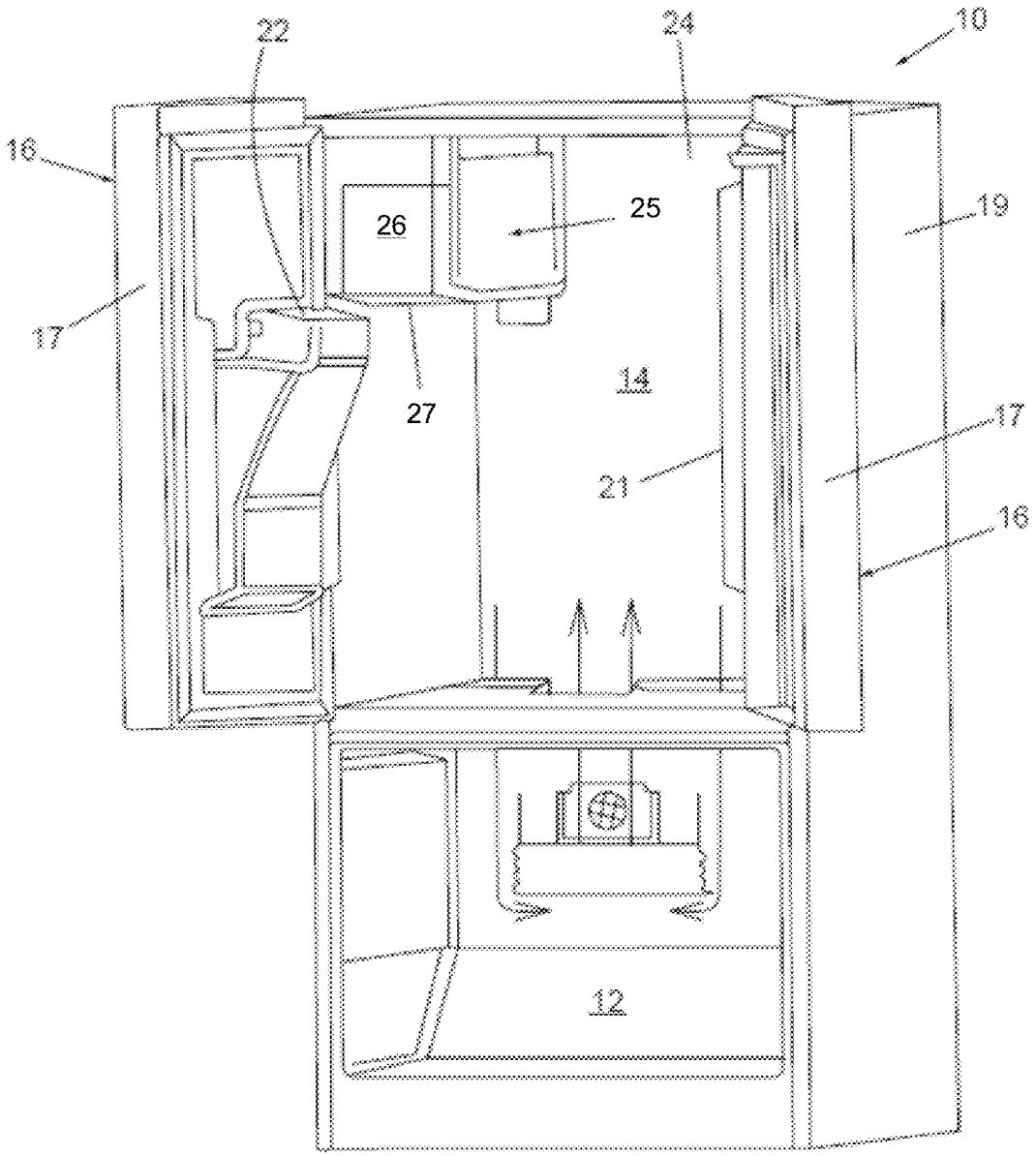
FIG. 2 is a front perspective view of the refrigerator of FIG. 1 showing the doors of the fresh food compartment in an opened position and the drawer of the freezer compartment removed.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 26 (FIG. 2) of an ice maker 25 disposed within the fresh food compartment 14. Ice pieces from the ice bin 26 can exit the ice bin 26 through an aperture 27 and be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possibly an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines both the fresh food compartment 14 and the freezer compartment 12. The liner 24 is engaged with the cabinet 19 and includes insulation disposed therebetween, such as a sprayed-in insulation.

The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
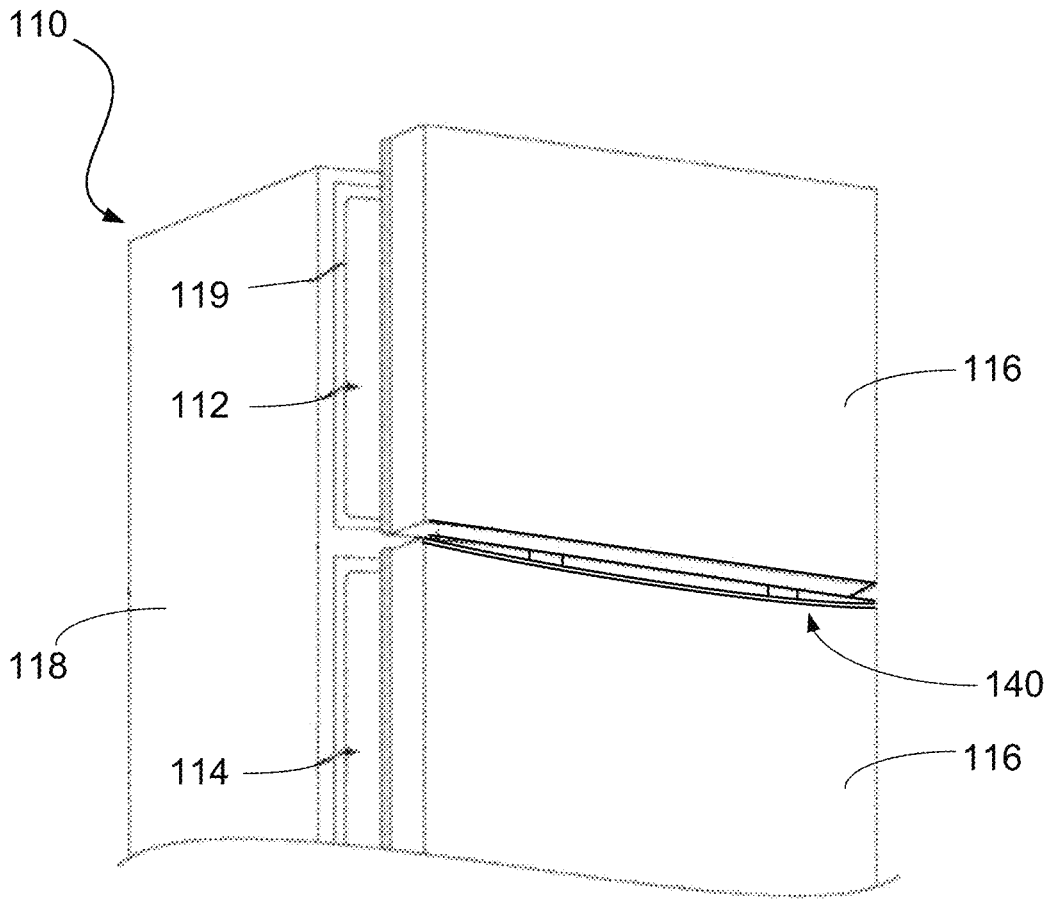
FIG. 3 is a partial front perspective view of a household two-door, top mount refrigerator according to the present disclosure, the view showing doors of the bottom fresh food compartment and of the top freezer compartment slightly ajar.

Turning now to FIG. 3, a portion of another refrigerator 110 is illustrated, though the refrigerator 110 is shown having a top mount freezer configuration and a single door for the bottom-located fresh food compartment, as compared to the refrigerator 10 having French doors 16 and a bottom mount freezer compartment 12. The refrigerator 110 is otherwise substantially similar to the refrigerator 10 discussed above except as discussed below. Aspects of the refrigerator 110 that are similar to aspects of the refrigerator 10 are identified with the same reference numbers, but indexed by 100. It will be appreciated that aspects of the refrigerator 10 may be incorporated into the refrigerator 110 and vice versa.

Referring now in detail to FIG. 3, the refrigerator 110 includes a set of vertically-separated doors 116 that engage with a body 118. The lower door 116 is provided for selectively closing (and thus also allow for selective opening of) the fresh food compartment 114. The upper door 116 is provided for selective closing and opening of the freezer compartment 112. The illustrated embodiment of the refrigerator 100 shows both doors 116 being hinge-mounted to the body 118 of the refrigerator 100 and a liner 119 mounted to the body 118. As will be appreciated, either door 116 can be hinge-mounted on either of the left or right side.

In other embodiments, one or more of the doors 116 may be attached to a drawer that is at least one of slideable or tiltable relative to the body 118 to allow for access to the respective compartment 112 or 114.

Figure 4:
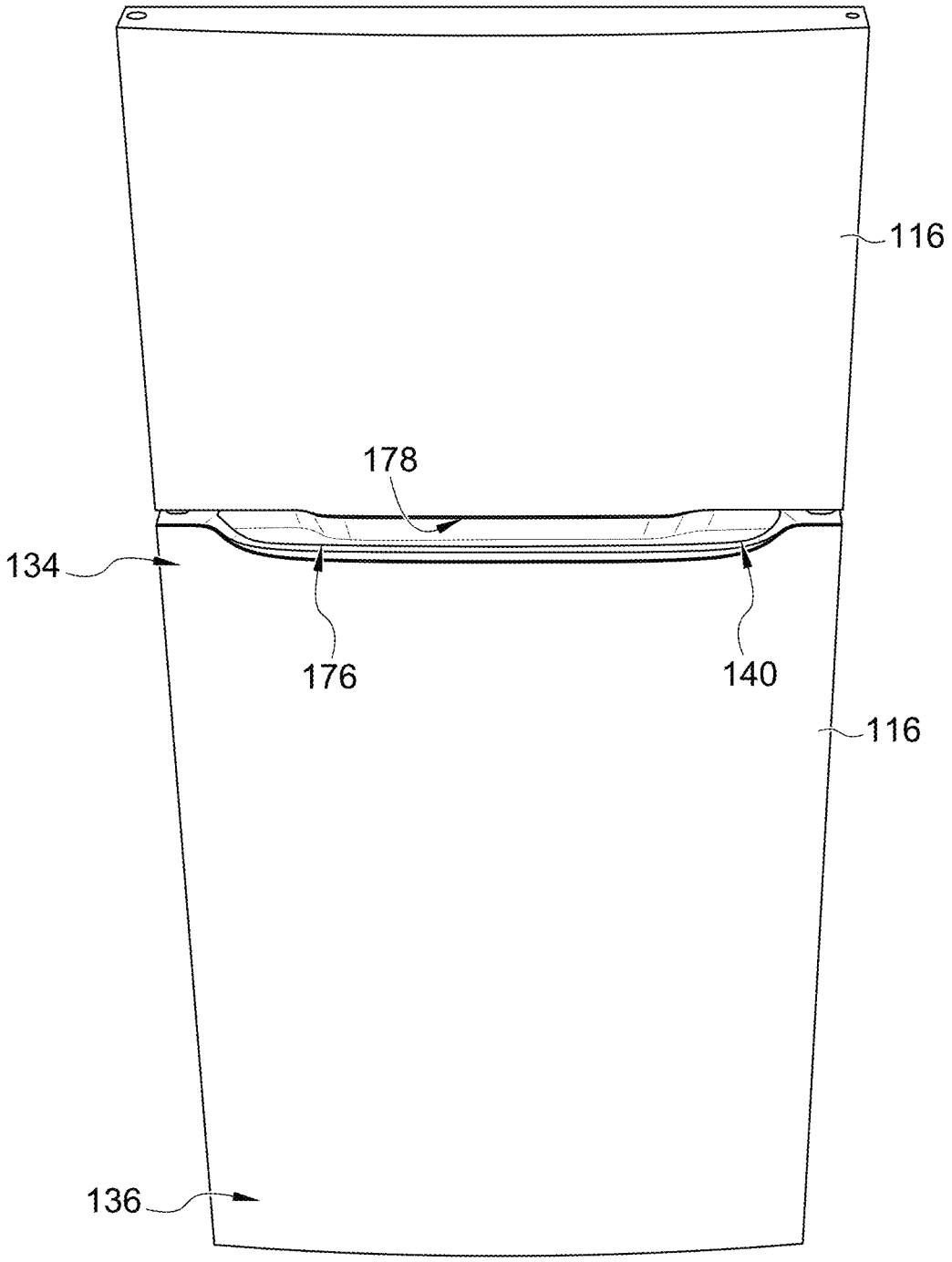
FIG. 4 is a front perspective view of the doors of the refrigerator of FIG. 3, unmounted, and separate from the body of the refrigerator.
Figure 5:
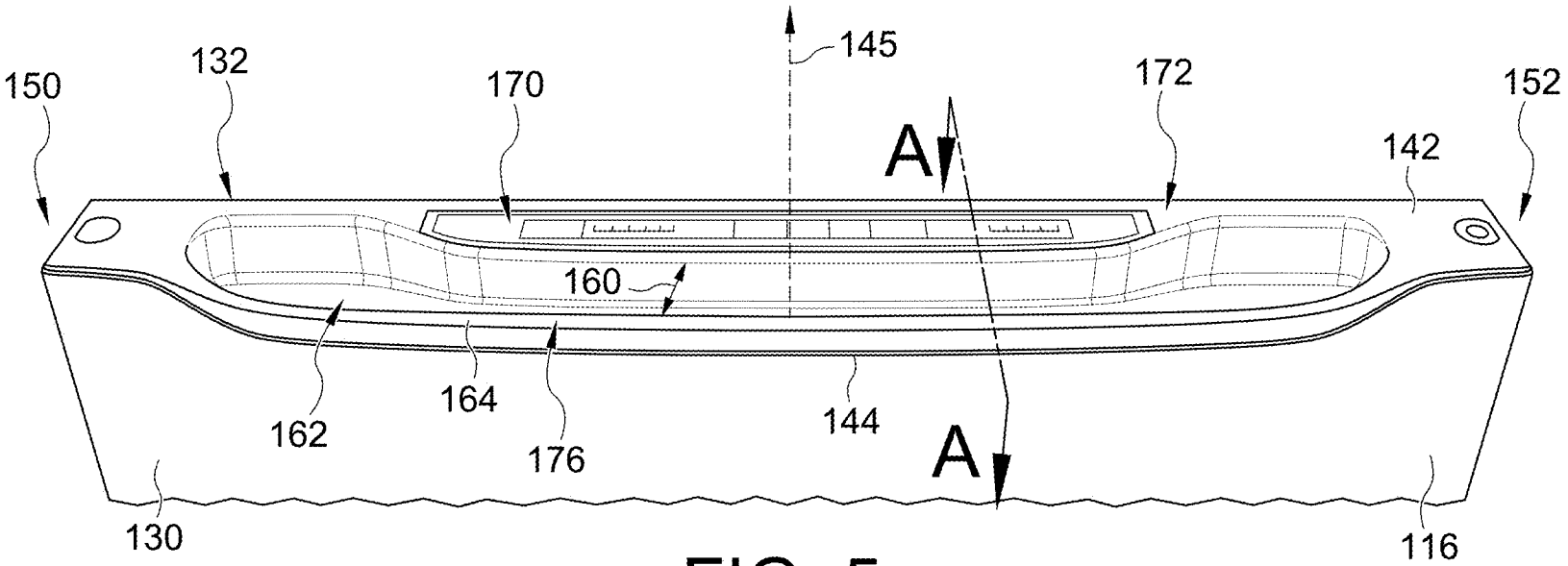
FIG. 5 is a partial top perspective view of the door of the bottom compartment of the refrigerator of FIG. 3.
Figure 6:
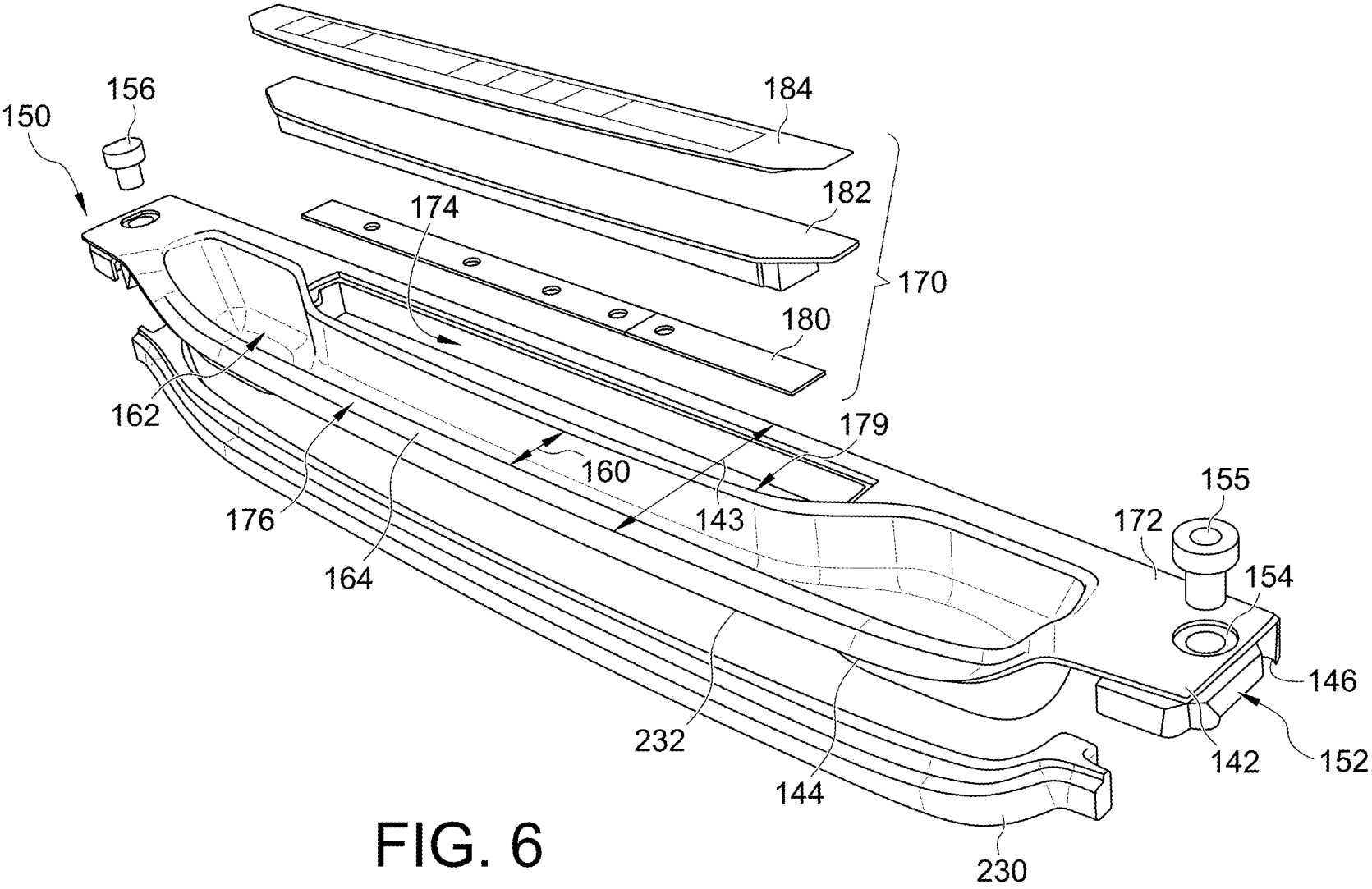
FIG. 6 is a perspective exploded view of the top endcap of the door of the bottom compartment of the refrigerator of FIG. 3.

Referring now to FIGS. 4 to 6, the description provided below is directed towards the lower door 116 of the fresh food compartment 114, but is equally-applicable to the upper door 116 of the freezer compartment and also equally-applicable to a drawer-mounted door. The depicted lower door 116 includes a front panel 130 and a rear panel 132. The front panel 130 is disposed outwardly from the fresh food compartment 114 and the rear panel 132 faces the compartment 114 when the door 116 is engaged with the body 118. The panels 130 and 132 extend vertically from top portions 134 to bottom portions 136 and are spaced from one another at least at these top and bottom portions 134 and 136. The tops and bottoms of the door 116 are closed by door end closure assemblies 140 that extend between the front and rear panels 130 and 132 to couple these panels 130 and 132 to one another. In some embodiments, the door end closure assemblies will be different at the top and bottoms of each door. After assembly, an insulating foam is injected into the interior of the door to provide thermal insulation and structural rigidity to the door.

In some embodiments, the bottom door end assembly may be omitted. In some embodiments, a door end closure assembly 140 may be used alternatively or additionally at one or both sides of the door 116. Accordingly, it will be appreciated that while the door end closure assembly 140 at the top of the door 116 is described below, the description may be equally-applicable to another door or location of end closure assembly on the door 116 or on another door. It is further contemplated that the invention described herein may also be used on a door that does not include a separate end cap. For example, the sheet metal that forms the front of the door can be bent over to thereby form a top edge of the refrigerator door. In such a configuration, there is no separate end cap element. Even so, the user interface construction described herein could readily be applied to such a non-endcap construction. For example, the metal forming the top edge of the door can have a suitable cut-out for installing the user interface therein. Likewise, although not a top edge of the door, the invention described herein could also be used on other portions of the door, such as a side edge or bottom edge formed by folding over the sheet metal without the use of a separate end cap element.

The door end closure assembly 140 of the door 116 includes an endcap 142 extending between the front panel 130 and the rear panel 132 to couple the front panel 130 to the rear panel 132. A front edge 144 of the endcap 142 is mounted to the front panel 130, while a rear edge 146 (FIG. 6) of the endcap 142 is mounted to the rear panel 132. Between the front and rear edges 144 and 146, the endcap 142 extends along a thickness direction 143 of the door 116 that is generally orthogonal to a vertical axis 145 of the door 116.

In a direction generally orthogonal to each of the thickness direction 143 and to the vertical axis 145, the endcap 142 extends along a length between opposing longitudinal ends 150 and 152 of the endcap 142. As shown, the endcap 142 extends a full length of the top of the door 116, although in other embodiments, the endcap 142 may have a different length.

The right end 152 (with reference to the illustration of FIG. 5), includes a bearing housing that may be either a blind hole, or alternatively as shown a thru-hole 154 for allowing receipt of a hinge shaft. A bearing 155 is received at the right thru-hole 154. A thru-hole 154 at the opposite left end 150 is closed by a cap 156, and may be used for oppositely opening hinge-mounted doors.

As shown in the illustrated embodiments, the endcap 142 defines at least a portion of a recessed pocket handle gap 160 that is configured to receive at least a portion of a user's hand to allow for the selective opening of the fresh food compartment 114. The handle gap 160 is a gap that extends between the front and rear edges 144 and 146 of the endcap 142, and along at least a portion of the length of the endcap 142 between the opposing longitudinal ends 150 and 152. However, it is contemplated that the user interface construction described herein can be used with an endcap that does not include a recessed pocket handle, or even with a door that does not include a separate endcap along the top edge and also that does not include a recessed pocket handle. For example, the endcap (or non-endcap top edge of the door) could have a substantially flat and/or uniform surface which can have a suitable cut-out for installing the user interface therein. Preferably the top surface of the user interface would be generally flush with the top surface of the flat endcap.

The illustrated endcap 142 shows the handle gap 160 being at least a portion of a grasping cavity 162 that extends along a depth to a cavity bottom surface in the door 116, between the front and rear panels 130 and 132. The grasping cavity 162 extends along a longitudinal length of the endcap 142. The handle gap 160, and thereby the grasping cavity 162, allows a user room to place their hand, and specifically their fingers, to grasp a front ridge 164 of the endcap 142. This front ridge 164 defines a front portion of the grasping cavity 162 and of the handle gap 160 and serves as a handle in the depicted embodiment of FIG. 5.

In other embodiments, the door 116 generally, or the endcap 142 specifically, may include a handle extending outwardly (not shown) from one of the door 116 generally and/or the endcap 142, with the handle being disposed at least adjacent the endcap 142 such that the endcap 142 defines a portion of a handle gap 160 between the outwardly extending handle and the endcap 142.

The illustrated door end closure assembly 140 also includes an electronic user interface 170 engaged with the endcap 142. The user interface 170 generally is electrically connected to the main control system of the refrigerator and is configured to allow control of or to provide feedback regarding one or more aspects of the appliance to which the door is connected. For example, with respect to the refrigeration appliance 110, the user interface 170 may be used to control temperatures of the fresh food and/or freezer compartments 114 and 112, activate specialty modes such as a Quick Freeze mode, to vary lighting within the compartments 114 and 112, and/or to provide user feedback such as an indication of a door being left ajar, air filter status, and/or a compartment temperature being above or below a certain pre-programmed or user-chosen threshold. In other embodiments, where one of the compartments is a convertible compartment that can maintain either a fresh-food environment (i.e., above freezing temperature) or a freezer environment (i.e., below freezing temperature), the user interface 170 can provide the functionality of enabling the user to select the operational mode of the convertible compartment.

The user interface 170 extends along the handle gap 160 and is provided at an outer main surface 172 of the endcap 142. The main surface 172 extends along and between the grasping cavity 162 and an interface cavity 174 (FIG. 6) of the endcap 142, into which the user interface 170 is received and retained, with each of the grasping cavity 162 and interface cavity 174 opening to the outer main surface 172. The depicted outer main surface 172 has a lower portion 176 disposed at the front edge 144 of the endcap 142, which lower portion 176 has a height along the vertical axis 145 that is lower than a height of the outer main surface 172 at the rear edge 146 of the endcap 142. In this way, a vertical gap along the vertical axis 145 is provided between the lower portion 176 and a lower edge 178 (FIG. 4) of the door 116 of the top-mount freezer compartment 112. The vertical gap allows for a user to guide a hand into the handle gap 160 and grasping cavity 162, to thereby grasp the front ridge 164 of the endcap 142, which is disposed at the location of the front edge 144 and lower portion 176.

The interface cavity 174, like the grasping cavity 162, extends into the door 116 between the front and rear panels 130 and 132. The depicted interface cavity 174 and grasping cavity 162 extend generally parallel to one another along a longitudinal length of the endcap 142, although the cavities 174 and 162 are separated from one another by an outwardly-extending rib 179 of the endcap 142. The rib 179 is disposed between the cavities 174 and 162 and defines at least one side of each of the cavities 174 and 162. The presence of the rib 179 prevents overlap of the grasping cavity 162 by the user interface 170.

In the illustrated embodiment, the grasping cavity 162 has a depth along the vertical axis 145 that is greater than a depth of the interface cavity 174. The grasping cavity 162 also is located along the front edge 144 while the interface cavity 174 is located oppositely along the rear edge 146. It will be appreciated that in other embodiments, one or both of these features may be different, such as location of the cavities 162 and 174 being reversed, or the depths of the cavities 162 and 174 being equal or reversed.

Figure 7:
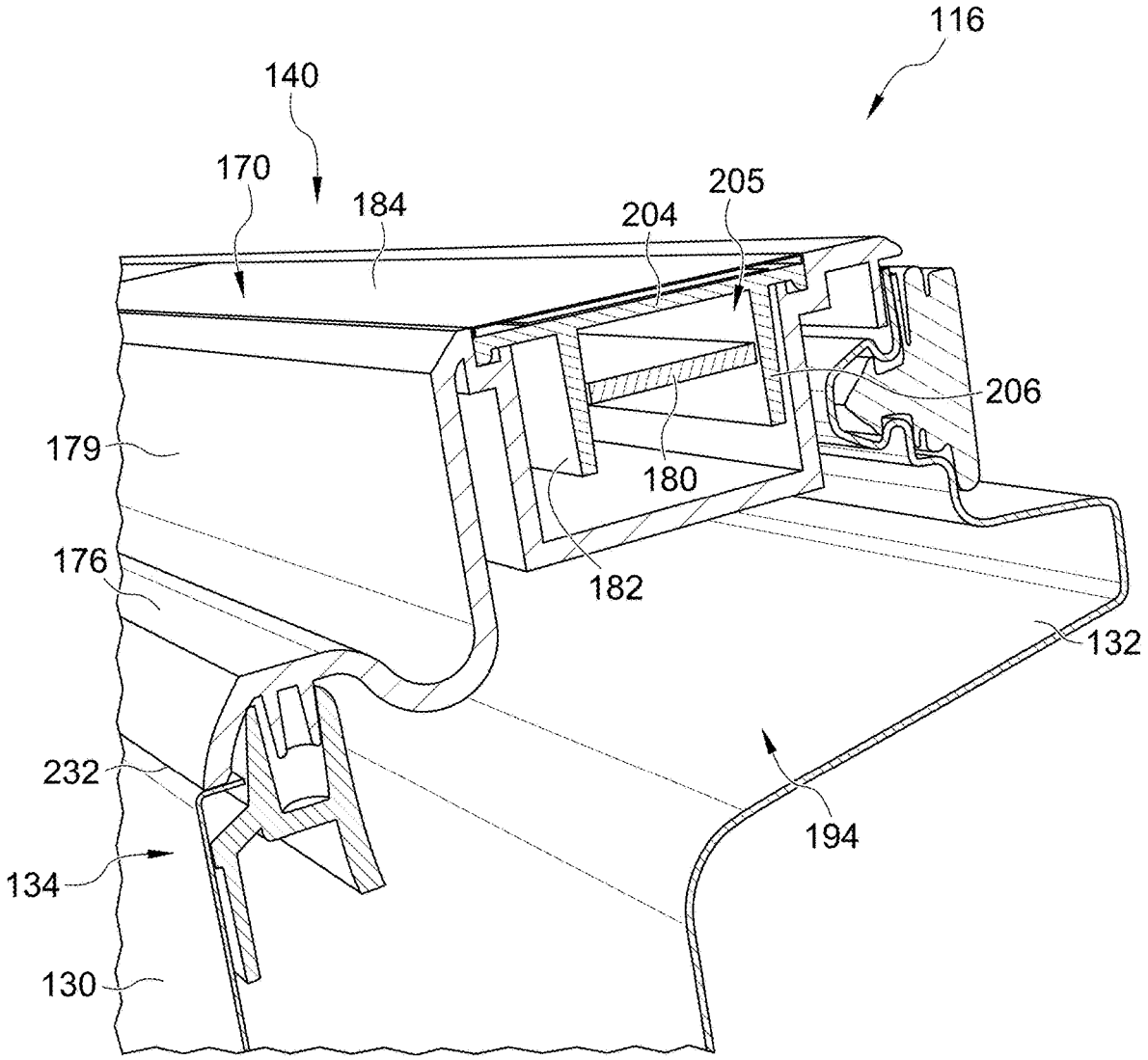
FIG. 7 is a perspective and partial-cross-sectioned view of the door shown in FIGS. 5 and 6, and taken along the line A-A of FIG. 5.
Figure 8:
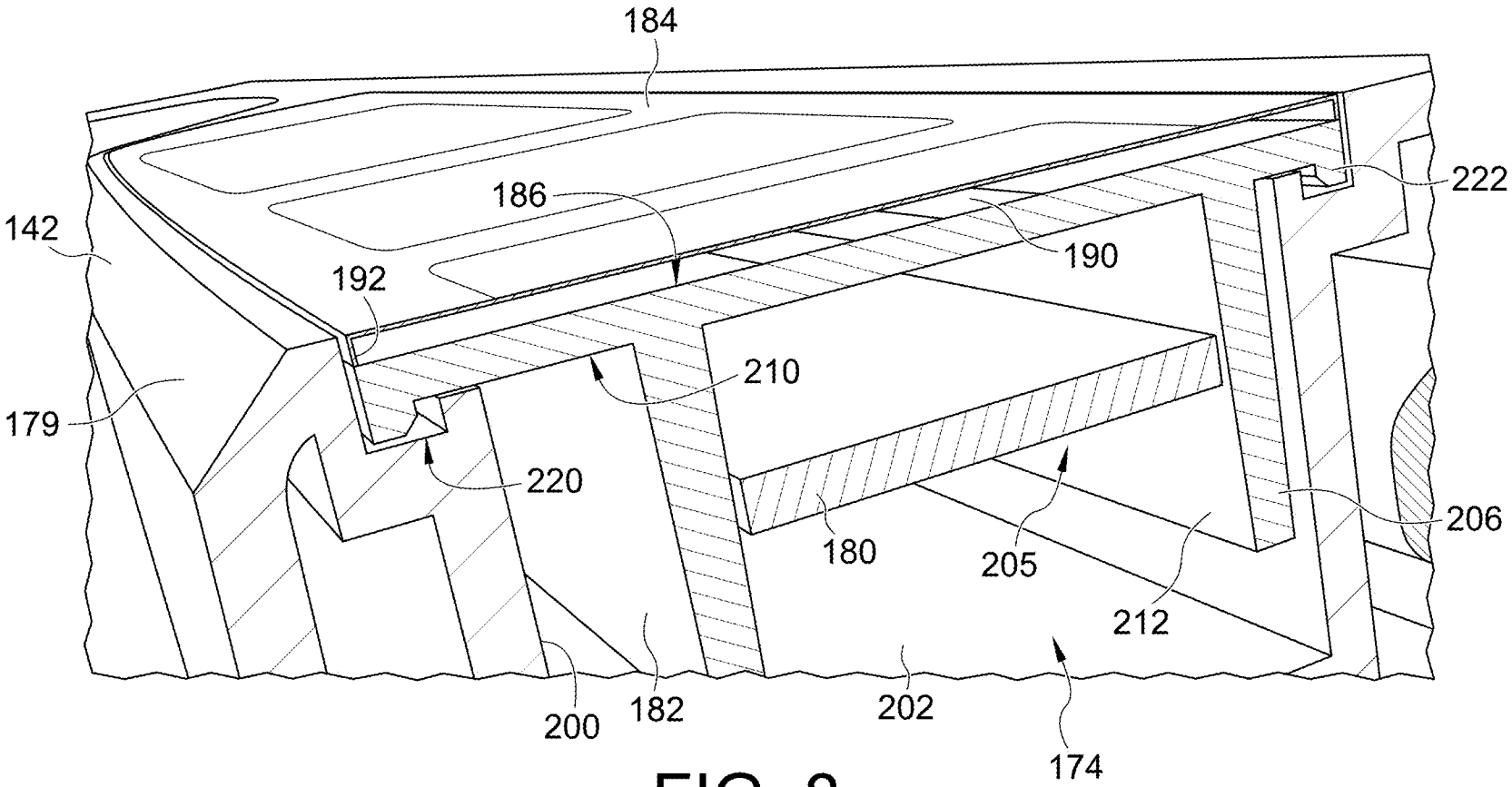
FIG. 8 is another perspective and partial-cross-sectioned view of the door shown in FIGS. 5 and 6.

Turning now to FIGS. 6-8, the user interface 170 will be described in greater detail. The user interface 170 includes an electronics board 180 for controlling one or more aspect of the refrigeration appliance 110, a board housing 182 receiving and providing protection for the electronics board 180 from the elements, and an overlay 184 disposed over an outer surface 186 of the board housing 182.

The electronics board 180 may be any suitable board, such as a printed circuit board having a plurality of discrete circuit elements connected to and disposed thereon. Generally, the electronics board 180 is in electrical communication with the board housing 182 and is electrically coupled to the outer surface 186 of the board housing 182, which may include user-activatable control elements 190. The user interface 170 is electrically connected to the main control system of the refrigerator, via wires or optionally via a wireless transceiver.

The control elements 190 are configured to receive input, such as from a user, and to subsequently send signals to the electronics board 180, which in turn may then cause to be varied one or more aspects of the refrigeration appliance 110, such as lighting, temperature, etc. The control elements 190 may include one or more of resistive or capacitive elements. Additionally or alternatively, the electronics board 180 and board housing 182 may be jointly configured to relay messages and/or alarms to the user, such as via auditory or visual signals. Thus, in some embodiments, the user interface 170 may include one or more lighting elements or sound-producing elements.

The overlay 184 is disposed over the outer surface 186 of the board housing 182 to visually delimit the control elements 190 from one another for the user, and thus may include written text on the overlay 184. The overlay 184 receives backlighting illumination from at least one illumination element, such as a LED, and preferably multiple illumination elements, on the electronics board 180 or by a separate illumination system. The illustrated overlay 184 includes a peripheral edge 192 that is received into the interface cavity 174 above the board housing 182 and may be configured to engage with a top or sides of the board housing 182. The peripheral edge 192 allows for a gap between an under surface of the overlay 184 and the outer surface 186 of the board housing. In some embodiments, the overlay 184 may include materials, such as on the under surface of the overlay 184, that may cause a signal to be sent to the electronics board 180 when provided in engagement with a control element 190 of the board housing 182. It is further contemplated that the board housing 182 and the illustrated overlay 184 can be incorporated into a single unified element. In one example, the overlay 184 can be integrated with the outer surface 186 of the board housing 182 as an in-mold decorated part where the graphics are embedded in an injection molded part. Other similar construction techniques are contemplated.

Power may be provided to at least one of the board housing 182 and the electronics board 180, such as by a power cable (not shown) extending through at least one of the front panel 130, rear panel 132, or endcap 142. For example, a cable may run through a hinge support and into an internal space 194 of the door 116, defined by the front panel 130, rear panel 132, and endcap 142. Such power cable may then pass into the interface cavity 174, such as through a hole sealed by a bushing or grommet, such as an elastic bushing or grommet. Additionally or alternatively, power may be provided to the user interface 170 such as by one or more energy storage devices, such as a battery, disposed within the door 116 and electrically connected to the user interface 170.

Referring now specifically to FIGS. 7 and 8, structural aspects of the user interface 170, and particularly of the board housing 182, will be described in greater detail. Generally, the user interface 170, and more particularly the board housing 182, is configured to cover and to close the interface cavity 174 about a periphery of the interface cavity 174 to reduce, limit, or altogether prevent moisture intrusion into the interface cavity 174 containing the electronics board in open (gaseous) communication therewith. Specifically, the board housing 182 is configured to retain the electronics board 180 separated from engagement with any surface of the interface cavity 174, including walls 200 of the interface cavity 174. The board 180 also is outwardly spaced from a bottom 202 of the interface cavity 174. In this way, even where moisture may intrude into the interface cavity 174 and collect at a cavity bottom 202, the board 180 will be outwardly spaced from such moisture.

To provide this protection, the board housing 182 includes an outer table 204 including the outer surface 186 disposed thereon. The electronics board 180 is retained in a board cavity 205 that is formed by an inner wall 206 extending from an under surface 210 of the outer table 204. That is, the board cavity 205 opens into the interface cavity 174, and the under surface 210 is disposed opposite the outer surface 186. The inner wall 206 extends into the interface cavity 174 and at least partially surrounds, such as fully-circumferentially surrounds, the electronics board 180. Engagement of the electronics board 108 with an inner surface 212 of the inner wall 206 may be made by any suitable method, such as tolerance fit, adhesive, welding, or mechanical features such as a slot, protrusion, etc. at one of the board 180 or inner surface 212. Via the engagement, a depth of the inner wall 206 into the interface cavity 174 is greater than a depth of the electronics board 180 in the interface cavity 174. The engagement may include electrical engagement of the electronics board 108 with the board housing 182, or the electrical engagement may be made by additional or alternative suitable means.

The board housing 182, and specifically the outer table 204, forms with the endcap 142 an S-shaped closure disposed circumferentially, such as fully-circumferentially, about the interface cavity 174. This S-shaped closure is a labyrinth closure formed by an outer periphery of the user interface 170 and a groove of the endcap 142. As noted above, this closure reduces, limits, or altogether prevents moisture intrusion into the interface cavity 174.

As illustrated, the endcap 142 includes an outwardly opening groove 220 that extends in a depth direction into the outer surface 172 to a groove bottom and is disposed about an opening of the interface cavity 174. A front length of this outwardly extending groove 220 is disposed between the front and rear edges 144 and 146 and also between the interface cavity 174 and the front ridge 164.

A downwardly extending lip 222 is disposed about a periphery of the outer table 204 and extends downwardly in a direction towards the cavity bottom 202 from the under surface 210. The downwardly extending peripheral lip 222 engages with and is received into the outwardly opening peripheral groove of the endcap 142 to provide the labyrinth closure. The lip 222 is disposed radially outward of and circumferentially surrounds the inner wall 206. The lip 222 may be retained in the groove 220 by any suitable method, such as tolerance fit, adhesive, welding, or mechanical features such as a slot, protrusion, etc. at one of the board housing 182 or endcap 142. This joint construction of the endcap 142 and the board housing 182 enables ease of manufacturing and any post-manufacturing maintenance of the user interface 170.

Still referring to FIG. 7, but also to FIG. 6, the door end closure assembly 140 optionally may include an intermediate member 230 engaged between the endcap 142 and the front panel 130 to aid in mounting the endcap 142 to the front panel 130. As shown in FIG. 7, the intermediate member 230 is disposed at a rear surface of each of the endcap 142 and the front panel 132 such as to be removed from view of the exterior of the door 116. Specifically the top portion 134 of the front panel 130 is disposed against the intermediate member 230 with a front most lip 232 of the endcap 142 being adjacent or engaged with the top portion 134 of the front panel 130. In other embodiments, the endcap 142 can be coupled directly to the front panel 130.

During assembly of the door 116, the endcap 142, front panel 130 and rear panel 132 are mounted to one another and the internal space 194 therebetween is filled with insulation. The insulation typically is fluidly injected, such as foamed, into the insulation space, which aids in retaining the endcap 142, front panel 130 and rear panel 132 mounted to one another.

In summary, a refrigeration appliance 10, 100 includes a compartment 112 for storing food items in a refrigerated environment, and a door 116 for engaging with an appliance body 118 and selectively closing the compartment 112. The door 116 has a front panel 130, a rear panel 132, and a door end closure assembly 140 providing an end of the door 116. The closure assembly 140 includes an endcap 142 extending between the front panel 130 and the rear panel 132 and a user interface 170 engaged with the endcap 142. The user interface 170 is configured to allow control of or to provide feedback regarding one or more aspects of the appliance 110 to the user. The endcap 142 defines at least a portion of a handle gap 160 configured to receive at least a portion of a user's hand to allow for selective opening of the compartment 112, and an interface cavity 174 for receiving the user interface 170. The interface cavity 174 is separated from the handle gap 160 and closed by the user interface 170.

While the above description of a door end closure assembly is directed to use with a door of a refrigeration appliance, and specifically a domestic refrigeration appliance, the door end closure assembly also has utility for use with commercial refrigeration appliances, dishwashers, microwaves, or other kitchen appliances.

In a separate embodiment, as shown at FIGS. 9-12, another user interface 370 is depicted, and is configured to allow control of or to provide feedback regarding one or more aspect of a refrigeration appliance 310 to a user. The user interface 370 is substantially similar to the user interface 170 discussed above, except as discussed below. Aspects of the user interface 370 that are similar to aspects of the user interface 170 are identified with the same reference numbers, but indexed by 300. It will be appreciated that aspects of the user interface 170 may be incorporated into the user interface 370 and vice versa.

Figure 9:
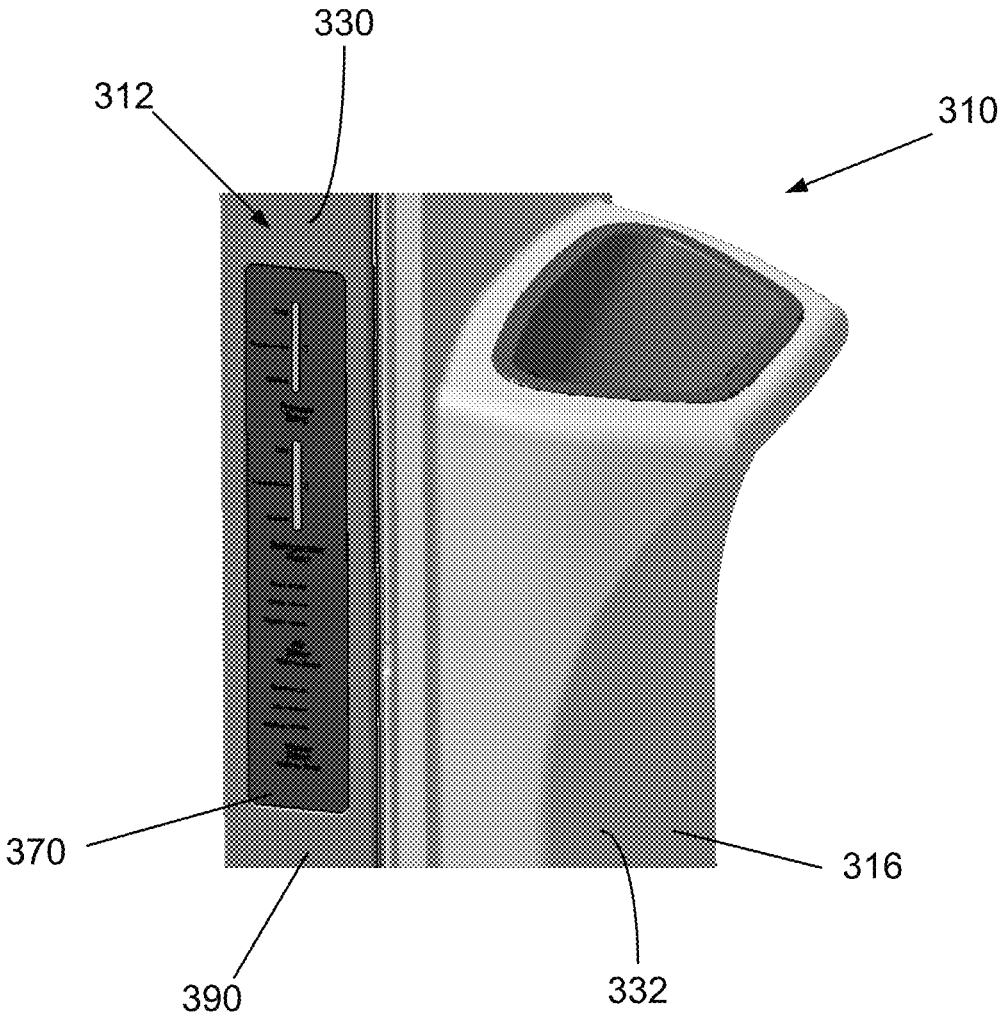
FIG. 9 is a partial perspective side view of another embodiment of a door of a refrigeration appliance, the door including a user interface.

FIG. 9 illustrates the user interface 370 mounted at a side surface 312 of a door 316 for selectively opening or closing a temperature-controlled compartment of the refrigeration appliance 310. The door 316 may be a door to a fresh food compartment or to a freezer compartment, such as being a door to a top mounted freezer compartment. Similar to the user interface 170 discussed above, mounting the user interface 370 at an externally-visible and externally-accessible portion of the refrigeration appliance 310 provides utility to the user, where a door 316 need not be opened to access the controls. Further, additional space may be provided at the internal compartments and internal shelving arranged without concern as to location of the controls.

The side surface 312 is one of two laterally-opposed faces extending between front and rear faces (FIG. 11) of the door 316. The illustrated side surface 312 is shown as being disposed at a side extension of the front panel 330. In other embodiments, one or both of these left and right faces of the door 316 can be disposed at side-extending extensions of one of the front and rear panels 330 and 332, or one or both can be disposed at a side endcap extending between the front and rear panels 330 and 332.

Figure 10:
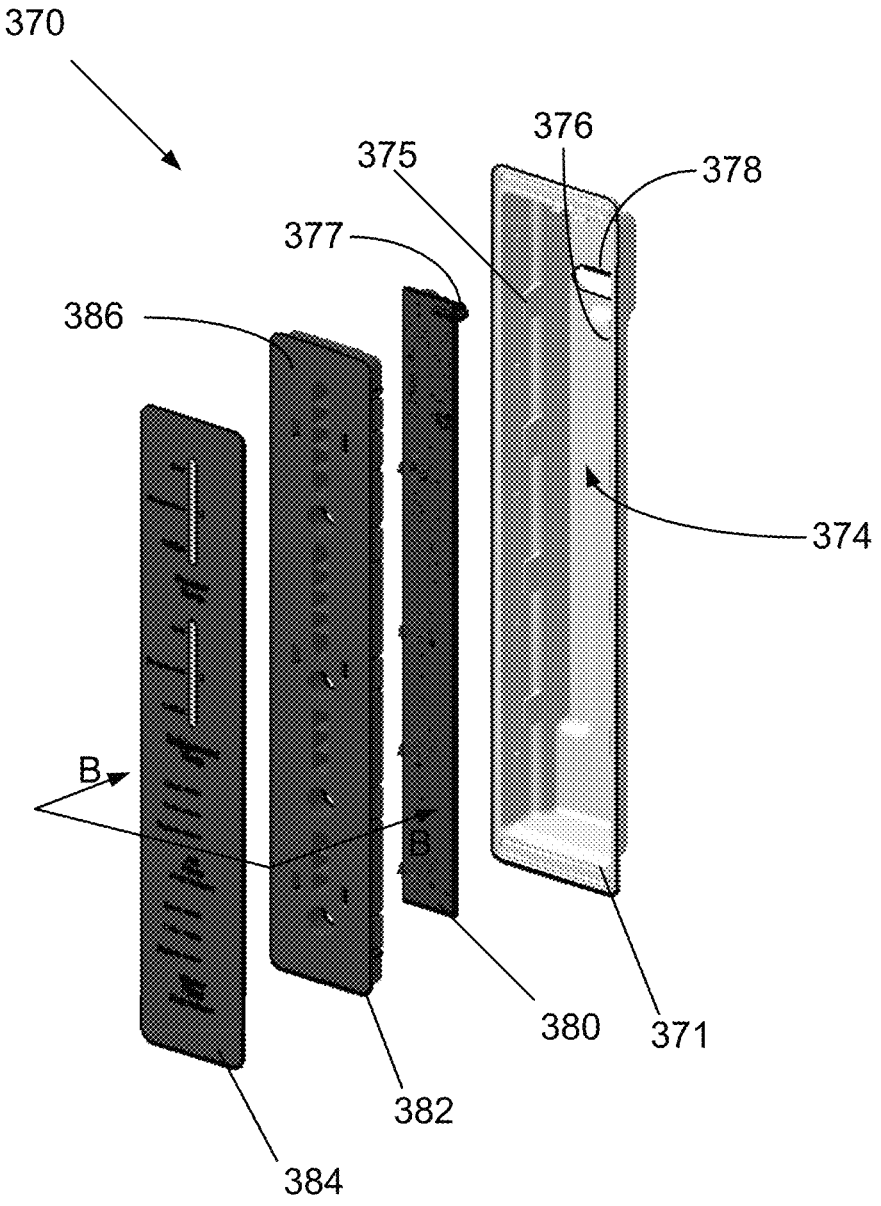
FIG. 10 is an exploded view of the user interface shown in FIG. 9.
Figure 11:
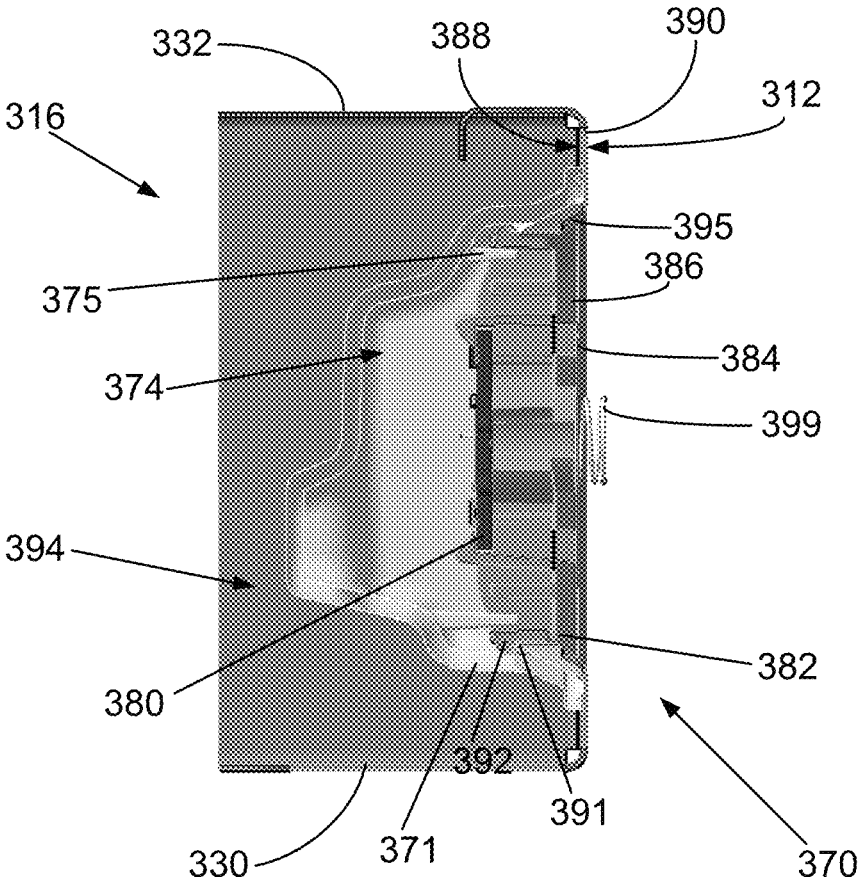
FIG. 11 is a partial bottom cross-sectional view taken along the line B-B of FIG. 9.

Turning specifically to FIGS. 10 and 11, the user interface 370 includes a bushing 371 (also referred to as a casing), an electronics board 380, a board housing 382 and a fascia overlay 384 overlaying a main outer surface 386 of the board housing 382.

As shown in FIG. 11, the bushing 371 is disposed at an internal surface 388 of the side panel portion 390, opposite the external side surface 312. By this mounting, no border is provided around the overlay 384 and thus the overlay 384 and top surface 386 of the board housing 382 are located generally flush with the side surface 312 of the side panel portion 390.

The bushing 371 can be mounted to the internal surface 388 by any suitable method, such as tolerance fit, adhesive, welding, or mechanical features such as a slot, protrusion, etc. at one of the bushing 371 or side panel portion 390. The illustrated bushing 371 can be maintained in position by internal door insulation, such as injected or spray foam insulation. In some embodiments, the bushing 371 can be mounted to an external surface of the side panel portion 390. In some embodiments, the bushing 371 can be mounted to or may be integral with an endcap of a door, such as a side or top endcap.

The bushing 371 includes an interface cavity 374 for receiving the board 380 and board housing 382, which may be mounted within the interface cavity 374 before or after foaming of the respective door 316. A through hole 378 is included at a bottom of the interface cavity 374/rear of the bushing 371 for receiving wires, a wire harness, and/or a wire harness grommet therein. The interface cavity 374 also includes housing guides 375 extending therefrom for engaging with the board housing 382. At least one of the housing guides 375 includes a poka-yoke feature 376 for aligning with a complementary feature 377 (FIG. 10) of the board 380. The poka-yoke 376 is illustrated as one of the housing guides have a slot therethrough for receiving a key (complementary feature 377) of the board 380. Due to the presence of the key, the board 380 will only properly seat with the bushing 371 in one orientation, making the user interface 370 easier to assemble and reducing assembly errors.

As shown in FIG. 11, each of the bushing 371 and the board housing 382 include complementary snap features 391 and 392, respectively, for mounting the boarding housing 382 in the interface cavity 374. The board housing 382 is also retained in position and restrained from being pushed into the internal cavity 394 of the door 316 by an inwardly-extending lip 395 of the side panel portion 390, with which an external periphery of the board housing 382 is engaged. The inwardly-extending lip 395 extends about the interface cavity 374 and has a shape that is smaller than an outermost shape of the board housing 382.

Figure 12:
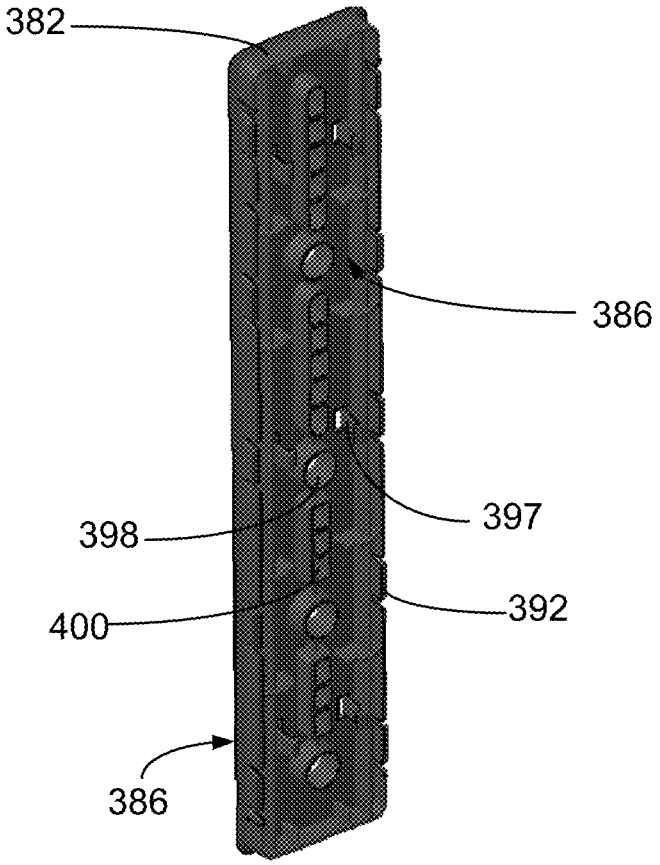
FIG. 12 is a rear perspective view of a board housing of the user interface shown in FIG. 9.

Turning to FIG. 12, a bottom 396 of the board housing 382 is depicted, showing additional snap features 397 for engaging the electronics board 380. Spring guides 398 extend through the board housing 382 for receiving springs 399 (FIG. 11) to provide resilience when a user pushes a portion of the overlay 384. The board housing 382 additionally includes light guides 400 that extend substantially from the board 380 to the outer main outer surface 386 to provide for separation of light and reduction of light bleed between LED's of the electronics board 380 aligned at the light guides 400 upon mounting of the board 380 to the board housing 382.

In another separate embodiment, as shown in FIGS. 13-17, a control box 500 and backbone assembly 502 is shown for housing and providing controls at an internal compartment of a refrigeration appliance for control of one or more aspects of the refrigeration appliance by the user. Generally, top mount refrigerators have temperature control boxes located within the fresh food compartment. Conventional control boxes include drain tubes and/or electrical plug connectors that need to be manually assembled to their mating member located adjacent the refrigerator liner, such as at a backbone assembly. The backbone assembly can be disposed between a rear surface of the liner (opposite a surface defining the interior of a cabinet) and an internal surface of the appliance casing. That is, during manufacturing, an assembler must search for a male end of a drain tube and/or plug connector at the refrigerator liner, connect said male end to its respective female end, and then secure the control box at the refrigerator liner, such as to the backbone assembly.

To lessen the number of manual steps needed for assembly of a control box to the backbone assembly, the control box 500 and backbone assembly 502 include respective self-alignment features for ease of mounting to one another and to slidably connect the male and female ends of electrical plug connectors to one another. That is, the control box 500, together with the backbone assembly 502, which also can be referred to as a return air duct, provides quicker assembly times and promotes uniform construction of refrigerators on an assembly line as compared to the more manual assembly discussed above. Due to the self-alignment features, varying placement of the temperature control box and incorrect mating of electrical connectors can be reduced. The alignment features also allow for ease of release of the control box 500 from the backbone assembly 502 for performing service on the control box 500, for example.

Figure 13:
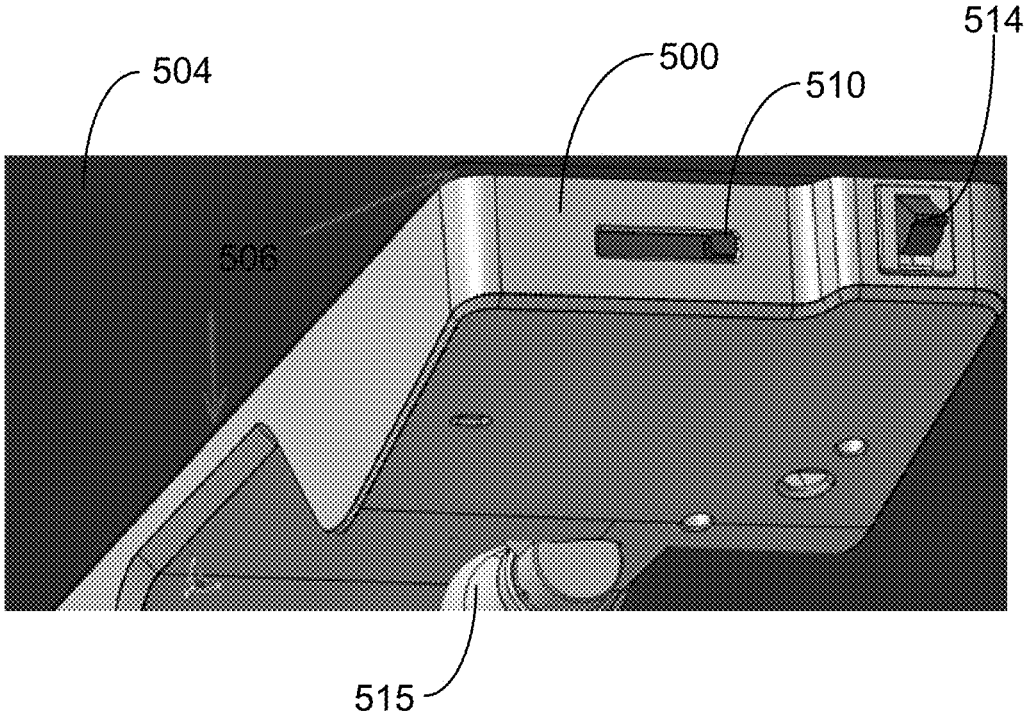
FIG. 13 is a bottom perspective view of a control box mounted within a compartment of yet another embodiment of a refrigeration appliance by a backbone assembly.

As shown in FIG. 13, the illustrated refrigerator liner 504 has a recess 506 that guides the temperature control box 500 to an installed position having mating of the electrical connectors. The temperature control box 500 has a temperature switch 510 that, when engaged by a user, such as being translated laterally, can actuate a position of a damper 512 (FIG. 14) within the control box 500. The temperature control box 500 also includes a door switch 514 that is engaged by the respective compartment door when the door is in a closed position, thus preventing activation of a light 515 within the compartment. When the door is opened and no longer engaged with the door switch 514, the door switch 514 will biasedly pivot to an "on" position and will activate the light 515.

Figure 14:
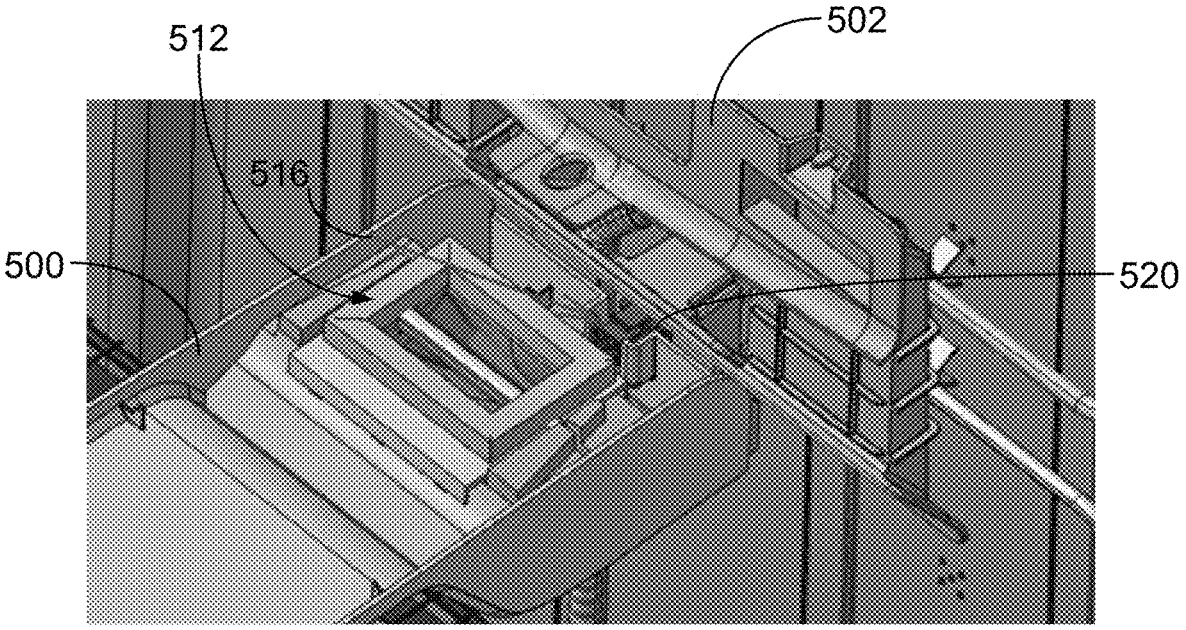
FIG. 14 is a top perspective view of the control box of FIG. 13 engaged with the backbone assembly.

Turning to FIG. 14, a male connector 516 is positioned at a rear end of the control box 500 for engaging a complementary female connector 520 at a front end of the backbone assembly 502. These connectors 516 and 520 easily engage with one another upon use of complementary alignment features at each of the control box 500 and backbone assembly 502 that are positioned and oriented to engage and align with one another.

Figure 15:
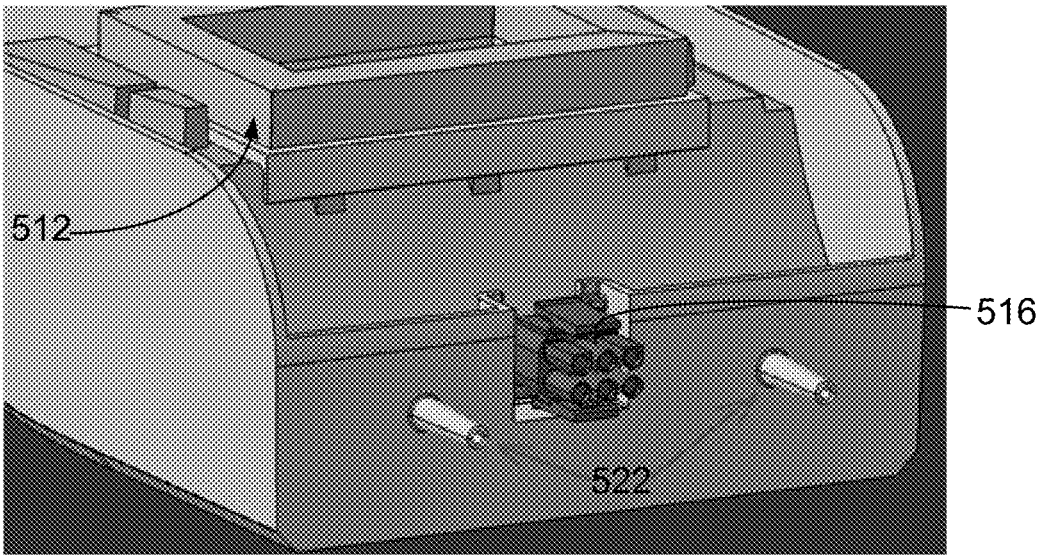
FIG. 15 is a rear perspective view of the control box of FIG. 13.
Figure 16:
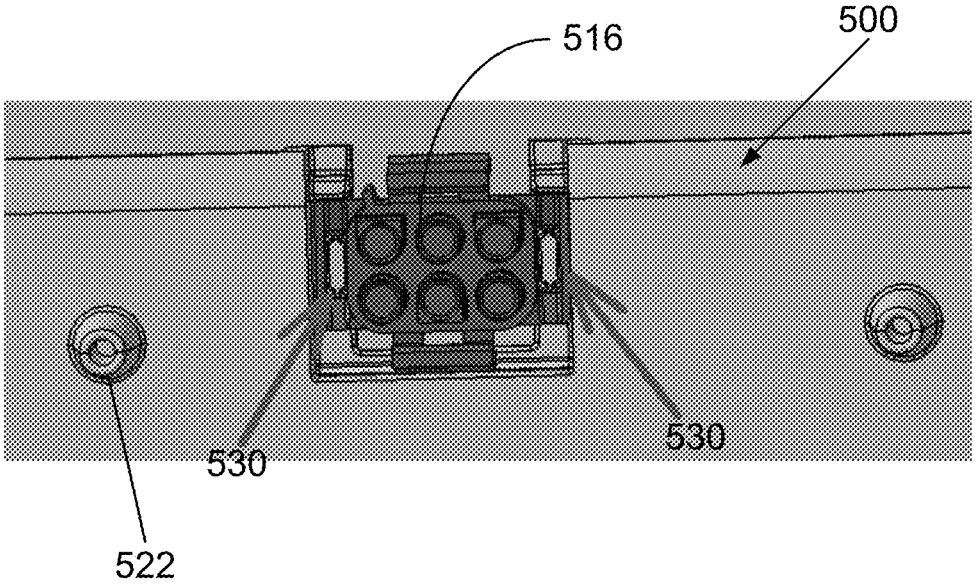
FIG. 16 is another rear view of the control box of FIG. 13.
Figure 17:
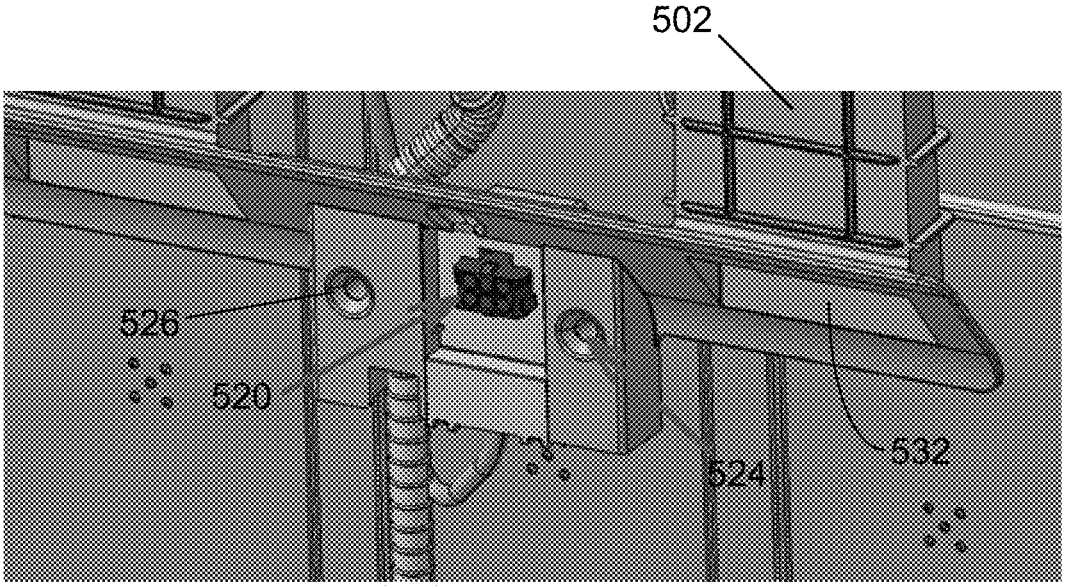
FIG. 17 is a front perspective view of the backbone assembly of FIG. 13.

Specifically, looking to FIGS. 15 to 17, the illustrated temperature control box 500 includes a pair of locating pins 522 for engaging and being inserted into a pair of locating holes 524 of the backbone assembly 502. The locating holes 524 are illustrated as having a tapered lead-in 526 to aid to aligning the pins 522 within the holes 524. Once the locating pins 522 and the locating holes 524 are adequately aligned, the assembler should easily be able to slidably connect the male and female electrical plug connectors 516 and 520. In this manner, when the locating pins 522 are within the alignment holes 524, the male connector 516 can be mated with the female connector 520 without searching for either of the male or female connectors 516 and 520 by the assembler being necessary. In other embodiments, any suitable number of locating pins 522 and locating holes 524 may be used. In other embodiments, the control box 500 may include one or more locating holes 524 and the backbone assembly 502 may include one or more locating pins 522.

Referring now to FIGS. 15 and 16, and to the control box 500 in particular, the box 500 includes the male connector 516 disposed at a rear side of the control box 500. The male connector 516 is removably securable to the rear side via crush ribs 530. In this manner, the male connector 516 may be released from the control box 500, such as for service, repair, replacement, etc. The box 500 also includes the damper 512 that selectively allows/prohibits a predetermined amount of air to enter one compartment from another, such as to enter the fresh food compartment from the freezer compartment, and as controlled by the temperature switch 510 (FIG. 13).

Referring next to FIG. 17 and to the backbone assembly 502 in particular, the assembly 502 includes at least one return air duct 532 positioned adjacent the fresh food compartment in the space between the inner refrigerator liner (not shown) and the metal refrigerator back plate or casing. The return air duct 532 directs air from the fresh food compartment to the freezer compartment.

Figure 18:
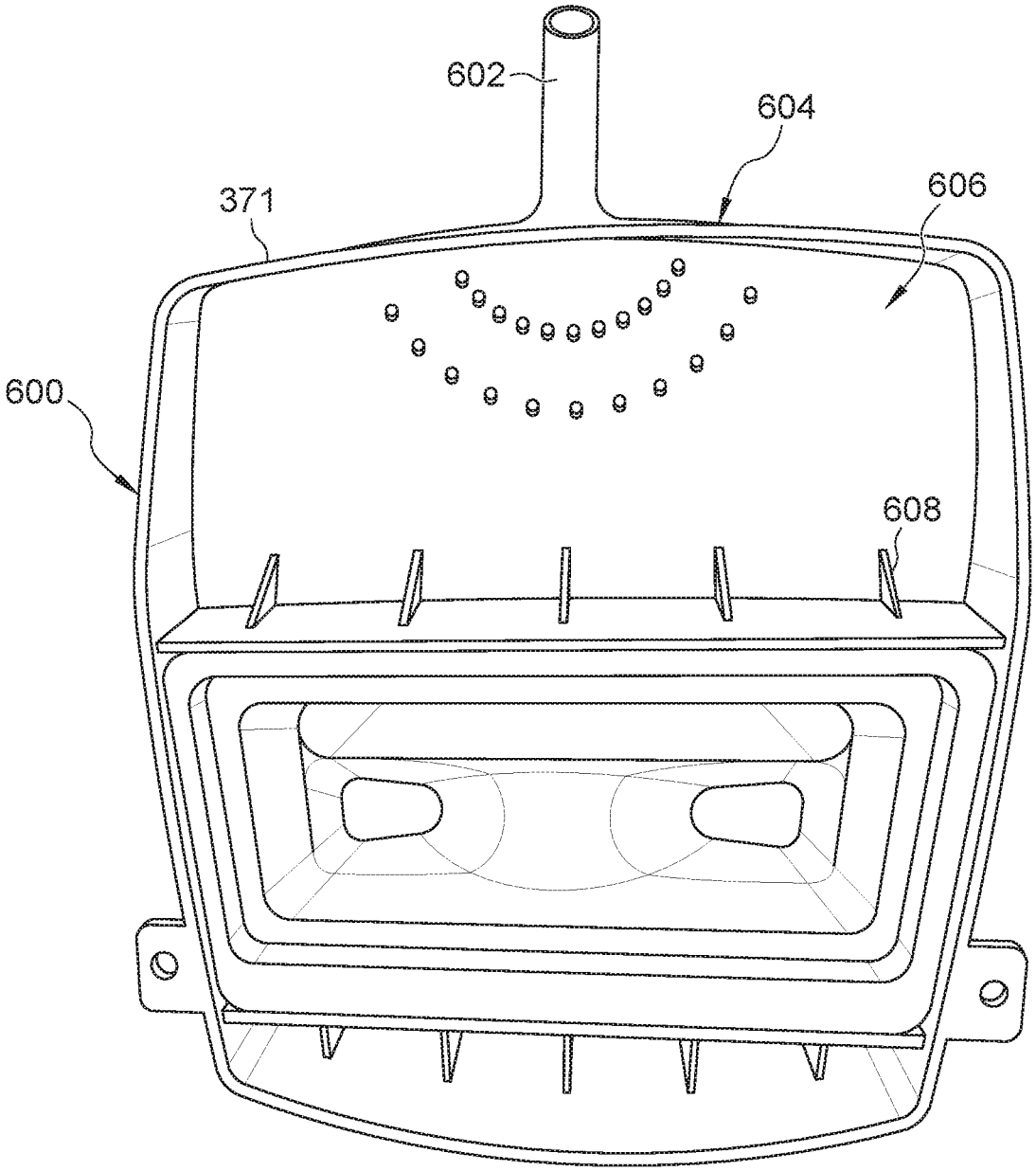
FIG. 18 is a top view of a control box housing of a different embodiment than the control box of FIGS. 13 to 17.
Figure 19:
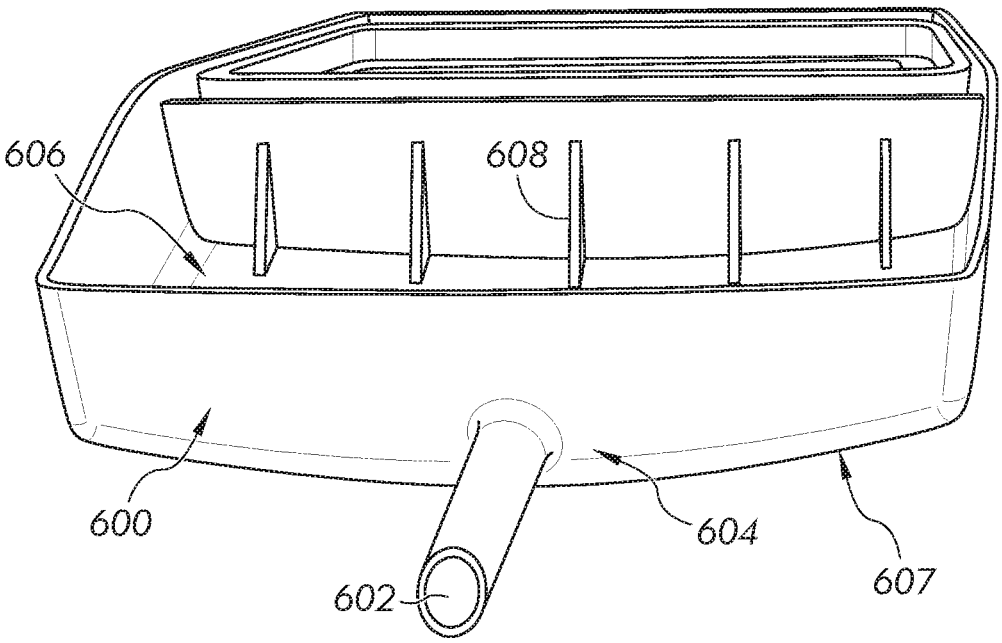
FIG. 19 is a front perspective view of the control box housing of FIG. 18.

In still another separate embodiment, as shown in FIGS. 18 and 19, a housing cover 600 of a control box is illustrated having features that aid in draining of moisture from the housing cover 600. The housing cover 600 has a drain 602 at a rear side 604 that is fluidly connected to an interior area 606 of the cover 600. The rear side 604 has an outwardly-arched or convex shape to aid in directing fluids within the interior area 606 to the drain 602. As shown in FIG. 18, an under side 607 of the cover 600 also has an outwardly-arched or convex shape, to further aid in the direction of fluids to the drain 602. Stiffening ribs 608 are provided at internal walls to aid in retaining the shape of the cover 600, and thus again aiding in directing fluids to the drain 602. It will be appreciated that any of the features of the cover 600 discussed above may be applied to the control box 500.

Figure 20:
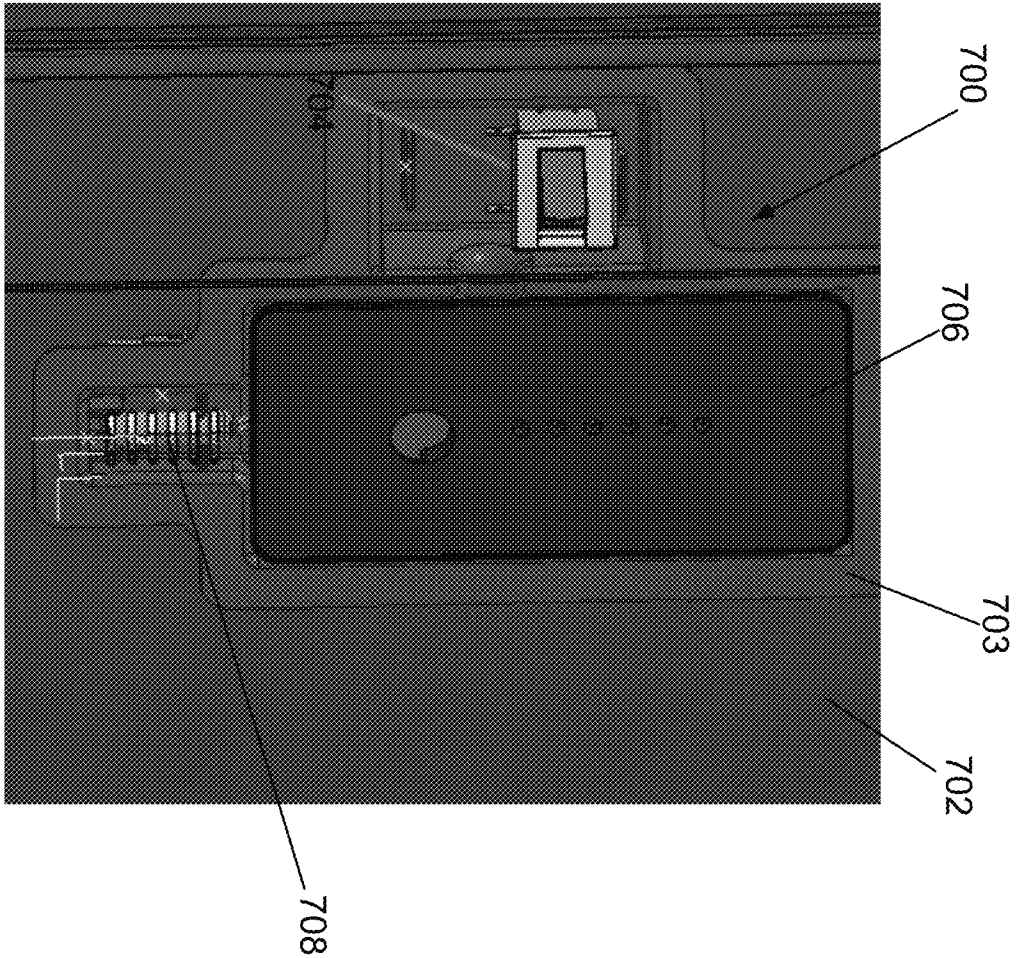
FIG. 20 is a diagrammatic perspective view of a control box mounted within a compartment of still another embodiment.
Figure 21:
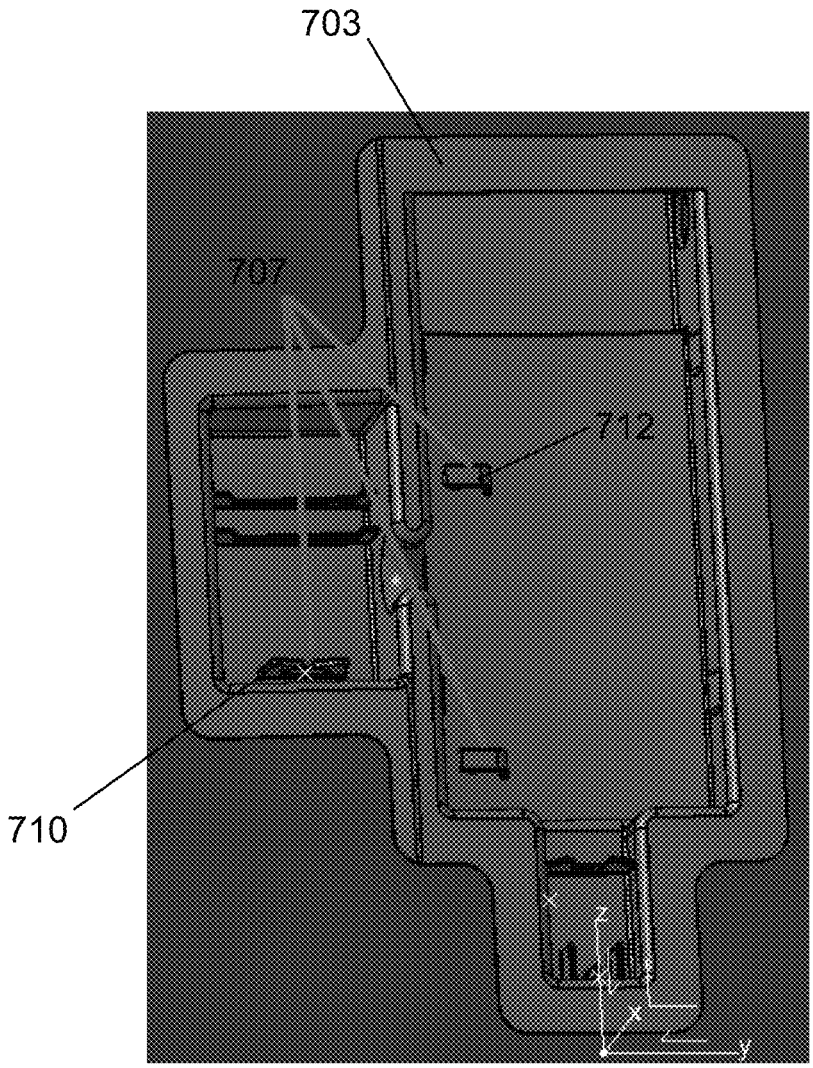
FIG. 21 is a diagrammatic view of the control box of FIG. 20.
Figure 22:
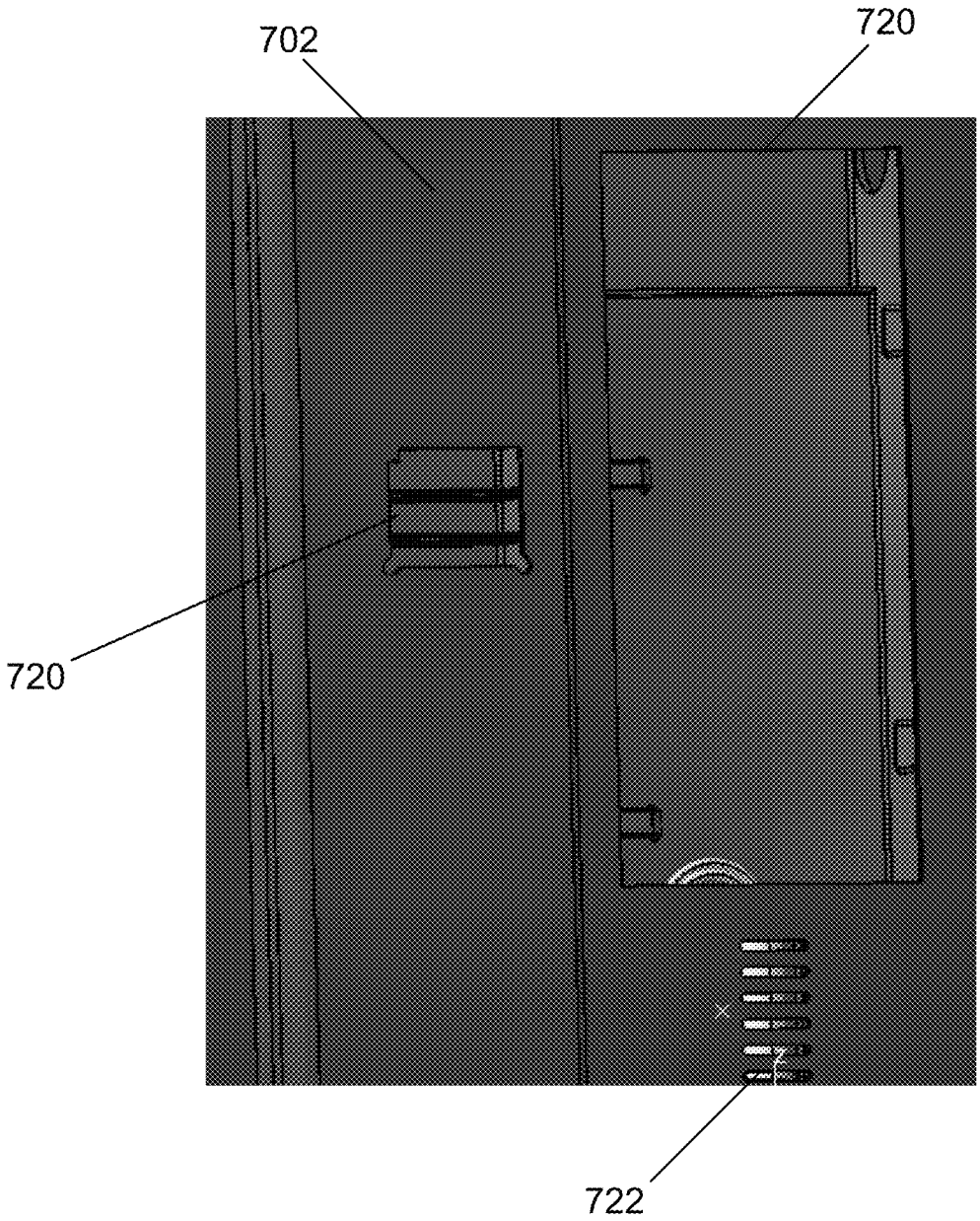
FIG. 22 is another diagrammatic view of the control box of FIG. 20.

In yet another separate embodiment, as shown in FIGS. 20 to 22, another control box 700 is shown for being mounted to an external surface of a liner 702 of a refrigeration appliance. The external surface is at the side opposite the interior of the refrigeration appliance and thus the control box 700 must be mounted prior to foaming of the cabinet of the appliance. For example, the control box 700 may be mounted adjacent the fresh food compartment of the appliance.

Turning first to FIG. 20, retained by and mounted at a housing 703 of the control box 700 are a light switch 704 for activating light in one or more compartments of the appliance, a side control panel 706 to regulate temperature of one or more of the compartments, and a thermistor 708 for measuring temperature at the compartment to which the thermistor is exposed —in the illustrated case, the fresh food compartment. When mounted to the liner 702, the thermistor 708 is mounted in a vertical position allowing for ease of serviceability.

By including all three of these components in a single control box rather than at two or more separate control boxes, wiring for all three of these components may be jointly run to and from the control box 700 via a single wire harness. Referring to FIG. 21, the housing 703 includes wire guiding features 707 including one or more wire traps 710 and one or more wire enclosures 712 for guiding and retaining the wire harness. During manufacturing, the wire harness may be shipped jointly with the housing 703 where it is secured at the guiding features 707.

FIG. 22 illustrates pierces 720 or holes in the liner 702 that allow for access to the light switch 704, side control 706, and also allow for gaseous transfer from the inside of the respective compartment to the thermistor 708. The pierces 720 include slots 722 for allowing the gaseous transfer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

What is claimed is:

1. The A refrigeration appliance comprising:

a body defining a compartment for storing food items in a refrigerated environment;

a door for engaging with the body and selectively closing the compartment, the door having a front panel and a rear panel, the front panel disposed outwardly from the compartment and the rear panel facing the compartment when the door is engaged with the body; and a door end closure assembly providing an end of the door adjacent to each of the front panel and the rear panel, the door end closure assembly including an endcap extending between the front panel and the rear panel and a user interface engaged with the endcap, the user interface configured to allow control of, and/or to provide feedback regarding, one or more aspects of the appliance to the user, wherein the endcap defines at least a portion of a handle gap configured to receive at least a portion of a user's hand to allow for selective opening of the compartment, wherein the endcap includes an interface cavity for receiving the user interface, the interface cavity separated from the handle gap and closed off by the user interface, wherein the user interface extends along the handle gap and is provided at an outer main surface of the endcap, and wherein the interface cavity and the handle gap extend generally parallel to one another along a longitudinal length of the endcap and are separated from one another by an outwardly extending rib of the endcap.

2. The refrigeration appliance of claim 1, wherein the endcap further includes a grasping cavity including the handle gap and extending along the user interface, and wherein the grasping cavity extends into the door between the front and rear panels.

3. The refrigeration appliance of claim 2, wherein the grasping cavity has a depth greater than that of the interface cavity.

4. The refrigeration appliance of claim 1, wherein the interface cavity extends into the door between the front and rear panels.

5. The refrigeration appliance of claim 1, wherein the interface cavity receives a board housing of the user interface, and wherein the interface cavity and the board housing jointly house an electronics board of the user interface such that the electronics board is retained out of engagement with any surface of the interface cavity.

6. The refrigeration appliance of claim 1, wherein the door is coupled to the body by at least one hinge or at least one drawer.

7. The refrigeration appliance of claim 1, wherein the endcap is configured to extend between a front edge and a rear edge, each extending along a length of the endcap, and wherein the interface cavity extends along the rear edge, and the handle extends along the front edge.

8. A refrigeration appliance comprising:

a body defining a compartment for storing food items in a refrigerated environment;

a door for engaging with the body and selectively closing the compartment, the door having a front panel and a rear panel, the front panel disposed outwardly from the compartment and the rear panel facing the compartment when the door is engaged with the body; and a door end closure assembly providing an end of the door adjacent to each of the front panel and the rear panel, the door end closure assembly including an endcap extending between the front panel and the rear panel and a user interface engaged with the endcap, the user interface configured to allow control of, and/or to provide feedback regarding, one or more aspects of the appliance to the user, wherein the endcap defines at least a portion of a handle gap configured to receive at least a portion of a user's hand to allow for selective opening of the compartment, wherein the endcap includes an interface cavity for receiving the user interface, the interface cavity separated from the handle gap and closed off by the user interface, wherein the user interface extends along the handle gap and is provided at an outer main surface of the endcap, and wherein an outer periphery of the user interface and an outer periphery of an opening of the interface cavity form a labyrinth closure to inhibit moisture infiltration into the interface cavity.

9. The refrigeration appliance of claim 8, wherein the user interface includes a board housing having a downwardly extending peripheral lip that engages with an outwardly opening peripheral groove of the endcap to provide the labyrinth closure.

10. The refrigeration appliance of claim 8, wherein the endcap is configured to extend between a front edge and a rear edge, each extending along a length of the endcap, and wherein the interface cavity extends along the rear edge, and the handle extends along the front edge.

11. A refrigeration appliance comprising:

a body defining a compartment for storing food items in a refrigerated environment;

a door for engaging with the body and selectively closing the compartment, the door having a front panel and a rear panel, the front panel disposed outwardly from the compartment and the rear panel facing the compartment when the door is engaged with the body; and a door end closure assembly providing an end of the door adjacent to each of the front panel and the rear panel, the door end closure assembly including an endcap extending between the front panel and the rear panel and a user interface engaged with the endcap, the user interface configured to allow control of, and/or to provide feedback regarding, one or more aspects of the appliance to the user, wherein the endcap defines at least a portion of a handle gap configured to receive at least a portion of a user's hand to allow for selective opening of the compartment, wherein the endcap includes an interface cavity for receiving the user interface, the interface cavity separated from the handle gap and closed off by the user interface, wherein the user interface extends along the handle gap and is provided at an outer main surface of the endcap, and wherein the user interface includes a board housing engaging with the endcap to cover an opening of the interface cavity, and wherein the board housing defines an inner wall extending into the interface cavity and surrounding a board cavity that opens into the interface cavity for retaining and housing an electronics board of the user interface.

12. The refrigeration appliance of claim 11, wherein the board housing is configured to retain the electronics board separated from any walls of the interface cavity and outwardly spaced from a bottom of the interface cavity.

13. The refrigeration appliance of claim 11, wherein the board housing includes an inner wall disposed radially inward of the downwardly extending ridge and disposed circumferentially about the electronics board, and wherein the inner wall is received into the interface cavity, with a depth of the inner wall in the interface cavity being greater than a depth of the electronics board in the interface cavity.

14. The refrigeration appliance of claim 11, wherein an outer surface of the board housing includes user-activatable elements, wherein a user overlay is disposed over the board housing to visually delimit the elements from one another for the user, and wherein the elements are electronically-coupled to the electronics board to provide signals thereto.

15. The refrigeration appliance of claim 11, wherein the endcap is configured to extend between a front edge and a rear edge, each extending along a length of the endcap, and wherein the interface cavity extends along the rear edge, and the handle extends along the front edge.

16. The refrigeration appliance of claim 11, wherein the electronics board is electrically coupled to an outer surface of the board housing for being contacted by a user to thereby send signals to the electronics board.

17. A refrigeration appliance comprising:

a body defining a compartment for storing food items in a refrigerated environment;

a door for engaging with the body and selectively closing the compartment, the door having a front panel and a rear panel, the front panel disposed outwardly from the compartment and the rear panel facing the compartment when the door is engaged with the body; and a door end closure assembly providing an end of the door adjacent to each of the front panel and the rear panel, the door end closure assembly including an endcap extending between the front panel and the rear panel and a user interface engaged with the endcap, the user interface configured to allow control of, and/or to provide feedback regarding, one or more aspects of the appliance to the user, wherein the endcap defines at least a portion of a handle gap configured to receive at least a portion of a user's hand to allow for selective opening of the compartment, wherein the endcap includes an interface cavity for receiving the user interface, the interface cavity separated from the handle gap and closed off by the user interface, and wherein the user interface extends along the handle gap and is provided at an outer main surface of the endcap, and further including an intermediate member engaged between the endcap and the front panel to mount the endcap to the front panel.

18. The refrigeration appliance of claim 17, wherein the intermediate member is disposed at a rear surface of each of the endcap and the front panel such as to be removed from view.

19. The refrigeration appliance of claim 17, wherein the endcap is configured to extend between a front edge and a rear edge, each extending along a length of the endcap, and wherein the interface cavity extends along the rear edge, and the handle extends along the front edge.

20. The refrigeration appliance of claim 17, wherein an outer periphery of the user interface and an outer periphery of an opening of the interface cavity form a labyrinth closure to inhibit moisture infiltration into the interface cavity.

* * * * *